US005540018A

United States Patent [19]

Biggers

[11] Patent Number: 5,540,018

[45] Date of Patent: Jul. 30, 1996

[54] INTEGRATED WINDOW CONSTRUCTION SYSTEM FOR MOUNTING BOTH WINDOW SYSTEMS AND HURRICANE PROTECTION DEVICES

[75] Inventor: Douglas W. Biggers, Key iBiscayne, Fla.

[73] Assignee: Chill Pill, Inc., Key Biscayne, Fla.

[21] Appl. No.: 235,256

[22] Filed: Apr. 29, 1994

[51] Int. Cl.[6] ..... E06B 9/00

[52] U.S. Cl. ..... 52/202; 52/537; 49/464; 49/61

[58] Field of Search ..... 52/309.16, 202, 52/304.1, 204.5, 204.6, 204.7, 208, 203, 537; 49/50, 61, 62, 463, 464, 55, 57; 160/225, 228, 233

[56] References Cited

U.S. PATENT DOCUMENTS

| | | | |
|---|---|---|---|
| 2,667,245 | 1/1954 | Shink . | |
| 2,757,420 | 7/1956 | Roos . | |
| 2,878,536 | 3/1959 | Beeker | 49/464 X |
| 2,883,716 | 4/1959 | Kunkel . | |
| 3,349,517 | 10/1967 | Johnson . | |
| 3,745,704 | 7/1973 | Covington | 49/57 |
| 3,871,434 | 3/1975 | Hance | 160/91 |
| 4,074,483 | 2/1978 | Vickstrom . | |
| 4,333,271 | 6/1982 | DePaolo et al. | 52/202 X |
| 4,384,436 | 5/1983 | Green | 52/202 |
| 4,505,079 | 3/1985 | Black | 52/202 |
| 4,599,836 | 7/1986 | Melcher . | |
| 4,685,261 | 8/1987 | Seaquist . | |
| 4,753,056 | 6/1988 | Pacca . | |
| 5,226,466 | 7/1993 | Coddens | 52/202 X |
| 5,343,668 | 9/1994 | Gonzalez | 52/202 X |
| 5,345,716 | 9/1994 | Caplan | 49/61 |
| 5,347,775 | 9/1994 | Santos | 52/202 |
| 5,383,315 | 1/1995 | Birs | 52/202 |
| 5,390,454 | 2/1995 | Coddens | 52/202 X |

*Primary Examiner*—Carl D. Friedman
*Assistant Examiner*—Beth Aubrey
*Attorney, Agent, or Firm*—Lott & Friedland

[57] ABSTRACT

An integrated window construction system. The present invention provides an integrated window construction system for mounting both window units and hurricane shutters, comprising a header bracket which includes a window header bracket portion and an upper shutter bracket portion spacedly connected by an extended member; a sill bracket comprising a window sill bracket portion and a lower shutter bracket portion spacedly connected by an extended section; means for fastening the header bracket to a window header; means for fastening the sill bracket to a window sill; means for mounting the window unit between the header and sill brackets; and means for securing at least one hurricane shutter between the header and sill brackets.

56 Claims, 18 Drawing Sheets

INTEGRATED WINDOW CONSTRUCTION SYSTEM FOR MOUNTING BOTH WINDOW SYSTEMS AND HURRICANE PROTECTION DEVICES

TECHNICAL FIELD

This invention relates generally to an integrated window construction system, and this invention specifically relates to an integrated window construction system for mounting both window systems and hurricane protection devices.

BACKGROUND OF THE INVENTION

As a result of recent hurricanes, such as Hugo and Andrew, making landfall and devastating numerous structures, many community building codes now require newly constructed and renovated commercial establishments and residences to be equipped with hurricane protection for windows and doors.

Conventional methods for protecting windows from strong winds and flying debris associated with storms or hurricanes include covering the window with permanently attached hinged shutters or awnings when the storm approaches and uncovering the windows, leaving the shutters or awnings attached to the building in a decorative nature when not in use. This type of shutter or awning is usually installed to the exterior of the building after construction is complete as an additional step, increasing the time and costs associated with newly constructed buildings.

Removable protective panels, usually made of wood, aluminum or other shatter resistant materials, are also used to protect windows and doors during storms. A variety of means for mounting these panels exist, including bolting the panels directly to the exterior of the building or inserting the panels into brackets which are secured to the exterior of the building.

An example of a removable shutter and brackets therefor is illustrated in U.S. Pat. No. 4,685,261 to Seaquist, incorporated herein by reference. Seaquist generally describes a removable translucent and shatter resistant storm shutter removably secured within upper and lower brackets mounted on a window frame. Both brackets are generally U-shaped and include a drill groove for mounting onto the upper and lower sills of the window frame by a screw means. The major disadvantage associated with this type of system is that it requires an extra step, beyond the basic construction process of installing the window unit, to be installed. In large buildings and complexes which include numerous windows, the increased cost and time associated with adding shutter brackets after window units are installed can be substantial. Another disadvantage is that such brackets, when installed to the exterior of the building, may detract from the appearance of the building or damage the exterior coating or paint.

One possible solution to these problems is to provide an integrated window construction system wherein the shutter brackets are an integral part of the window brackets, eliminating the need for the extra step of shutter bracket installation, thereby saving time and costs. Such an integrated window construction system, wherein the header brackets and sill brackets incorporate both the window bracket portion and the shutter bracket portion, provides snug, custom fitting window protection, which does not detract from the exterior of a building or damage the exterior coating or paint.

An alternate solution for existing windows is to provide a shutter bracket system which can be secured to existing window brackets in a manner which provides the same snug, custom fitting window protection as an integrated system and does not detract from the exterior of a building or damage the exterior coating or paint.

SUMMARY OF THE INVENTION

The present invention solves significant problems in the art by providing an integrated window construction system for mounting both window systems and storm protection devices.

Generally described, the present invention provides an integrated window construction system for mounting both window units and hurricane shutters between a window header and a window sill, comprising a header bracket fastened to the window header comprising a window header bracket portion and an upper shutter bracket portion spacedly connected by an extended member, the extended member defining a space between the window units and the hurricane shutters; and a sill bracket fastened to the window sill comprising a window sill bracket portion and a lower shutter bracket portion spacedly connected by an extended section, the extended section defining a space between the window units and the hurricane shutters.

The upper shutter bracket portion of the header bracket, includes an inner grip and an outer grip extending vertically downward, wherein each grip includes a flared lower portion to ease insertion of the hurricane shutters between the grips. The window header bracket portion of the header bracket includes a front grip and a rear grip for retaining the window unit and a horizontal bracing cap between the front and rear grips, the bracing cap slidably adjusts to accept windows of various depths. The window bracket portion of the sill bracket includes a front edge and a raised rear lip for retaining the window unit and a horizontal bracing cap between the front edge and the raised rear lip, the bracing cap slidably adjusts to accept windows of various depths. In an alternate embodiment, the window header bracket portion of the header bracket comprises a sliding glass door bracket for retaining a sliding glass door and the window bracket portion of the sill bracket comprises a sliding glass door bracket for retaining a sliding glass door.

The shutter bracket portion of the sill bracket comprises an outer face which extends vertically upward from the window sill and a lower exterior horizontal lip which rests on the window sill. The outer face includes a bolt groove along the width of the sill bracket within which a head of a bolt may be disposed, with a stem of the bolt extending outward therefrom, allowing the bolt to slide along the bolt groove, and wherein the bolt extends through the hurricane shutter to secure the hurricane shutter. The hurricane shutter comprises a substantially rectangular panel like member having a narrow inwardly projecting surface and a wide inwardly projecting surface, wherein an elongated hole is positioned along a bottom edge of the wide inwardly projecting surface to allow for horizontal width adjustment of the hurricane shutters when at least two of the hurricane shutters overlap with a stem of the bolt penetrating the elongated hole, and wherein the bolts slide along the bolt groove for horizontal width adjustment of the hurricane shutters.

In an alternate embodiment, the outer face includes a plurality of studs, spacedly secured, wherein a stem of each of the studs extends outward therefrom, and wherein the stem extends through the hurricane shutter to secure the hurricane shutter, and wherein a lock bar prevents the studs from becoming dislodged.

In an alternate embodiment, the integrated window construction system for mounting both sheet glass windows and hurricane shutters between a window header and a window sill, comprises a header bracket fastened to the window header comprising an upper shutter bracket portion attached to a window header bracket portion; and a sill bracket fastened to the window sill comprising a lower shutter bracket portion attached to a window sill bracket portion. The window header bracket portion is substantially rectangular in shape, having a top side, a bottom side, an interior side, and an exterior side, wherein the top side is positioned adjacent to the window header for mounting to the header, the window header bracket portion further comprising a notch in the bottom of the window header bracket portion extending along the length of the header bracket between the interior side and the exterior side for insertion of a top edge of the sheet of glass, wherein a pair of grip arms within the notch secure the sheet of glass in place, the notch positioned such that a space is left between the sheet of glass and the hurricane shutter. The shutter bracket portion of the header bracket comprises an inner arm and an outer grip extending vertically downward with a flared lower portion to ease insertion of the hurricane shutter between the exterior side of the window bracket portion and the outer grip, the shutter bracket portion attaches to the bottom side against the exterior side of the window bracket portion through a horizontal mounting means extending inward from the inner arm. The window bracket portion of the sill bracket is substantially rectangular in shape, having a top side, a bottom, an interior side, and an exterior side wherein the bottom is positioned adjacent to the window sill for mounting, the window bracket portion further comprising a notch in the top of the window bracket portion of the sill bracket extending along the length of the sill bracket between the interior side and the exterior side for insertion of a bottom edge of the sheet of glass, wherein a pair of grip arms within the notch secure the sheet of glass in place, the notch positioned such that a space is left between the sheet of glass and the hurricane shutter. The shutter bracket portion of the sill bracket comprises a horizontal mounting arm and an outer face extending vertically downward, the shutter bracket portion attaches to the top side against the exterior side of the window bracket portion through the horizontal mounting arm. The outer face comprises a bolt groove along the width of the sill bracket within which a head of a bolt may be disposed, with a stem of the bolt extending outward therefrom, allowing the bolt to slide along the bolt groove, and wherein the bolt extends through the hurricane shutter to secure the hurricane shutter. The hurricane shutter comprises a substantially rectangular panel like member having a narrow inwardly projecting surface and a wide inwardly projecting surface, wherein an elongated hole is positioned along a bottom edge of the wide inwardly projecting surface to allow for horizontal width adjustment of the hurricane shutters when at least two of the hurricane shutters overlap with a stem of the bolt penetrating the elongated hole, and wherein the bolts slide along the bolt groove for horizontal width adjustment of the hurricane shutters.

In an alternate embodiment, the outer face includes a plurality of studs, spacedly secured, wherein a stem of each of the studs extends outward therefrom, and wherein the stem extends through the hurricane shutter to secure the hurricane shutter, and wherein a lock bar prevents the studs from becoming dislodged.

An alternate embodiment of the integrated window construction system for mounting both sheet glass windows and hurricane shutters between a window header and a window sill, comprises a header bracket fastened to the window header comprising a window header bracket portion and a upper shutter bracket portion spacedly connected by an extended member, the extended member defining a space between the window units and the hurricane shutters; and a sill bracket fastened to the window sill comprising a lower shutter bracket portion attached to a window sill bracket portion. The window header bracket portion is substantially rectangular in shape, having a top side, a bottom side, an interior side, and an exterior side, wherein the top side is positioned adjacent to the window header for mounting to the header, the window header bracket portion further comprising a notch in the bottom of the window header bracket portion extending along the length of the header bracket between the interior side and the exterior side for insertion of a top edge of the sheet of glass, wherein a pair of grip arms within the notch secure the sheet of glass in place, the notch positioned such that a space is left between the sheet of glass and the hurricane shutter. The shutter bracket portion of the header bracket, includes an outer grip extending vertically downward with a flared lower portion to ease insertion of the hurricane shutter between the exterior side of the window bracket portion and the outer grip. The window bracket portion of the sill bracket is substantially rectangular in shape, having a top side, a bottom, an interior side, and an exterior side wherein the bottom is positioned adjacent to the window sill for mounting. The shutter bracket portion of the sill bracket includes an outer face which extends vertically upward from the window sill and is snapped into the exterior side of the window bracket portion. The window construction system further comprises a notch formed between the top of the window bracket portion and the shutter bracket portion extending along the length of the sill bracket between the interior side and the exterior side for insertion of a bottom edge of the sheet of glass, wherein a pair of grip arms within the notch secure the sheet of glass in place, and wherein the notch is positioned such that a space is left between the sheet of glass and the hurricane shutter. The outer face comprises a bolt groove along the width of the sill bracket whereby a bolt may slide along the width of the sill bracket with the head of the bolt disposed in the bolt groove and the stem of the bolt extending outward therefrom. The hurricane shutter comprises a substantially rectangular panel like member having a narrow inwardly projecting surface and a wide inwardly projecting surface, wherein an elongated hole is positioned along a bottom edge of the wide inwardly projecting surface to allow for horizontal width adjustment of the hurricane shutters when at least two of the hurricane shutters overlap with a stem of the bolt penetrating the elongated hole, and wherein the bolts slide along the bolt groove for horizontal width adjustment of the hurricane shutters.

In an alternate embodiment, the outer face comprises a plurality of studs along the width of the sill bracket whereby the stem of the stud extends outward therefrom for attachment of the hurricane shutter, and wherein an internal stud mount prevents the studs from becoming dislodged.

An alternate embodiment of the integrated window construction system for mounting both sheet glass windows and hurricane shutters between a window header and a window sill, comprises a header bracket fastened to the window header comprising an upper shutter bracket portion attached to a window header bracket portion; and a sill bracket attached to the window sill comprising a lower shutter bracket portion. The window header bracket portion is substantially rectangular in shape, having a top side, a bottom side, an interior side, and an exterior side, wherein the top side is positioned adjacent to the window header for mounting to the header, the window header bracket portion further comprising a notch in the bottom of the window header bracket portion extending along the length of the header bracket between the interior side and the exterior side for insertion of a top edge of the sheet of glass, wherein a pair of grip arms within the notch secure the sheet of glass in place, the notch positioned such that a space is left between the sheet of glass and the hurricane shutter. The shutter bracket portion of the header bracket comprises an inner arm and an outer grip extending vertically downward with a flared lower portion to ease insertion of the hurricane shutter between the exterior side of the window bracket portion and the outer grip, the shutter bracket portion attaches to the bottom side against the exterior side of the window bracket portion through a horizontal mounting means extending inward from the inner arm. The shutter bracket portion of the sill bracket comprises an L-shaped member having an outer face extending vertically downward and a horizontal mounting arm, the shutter bracket portion attaches to sill through the horizontal mounting arm. The outer face comprises a bolt groove along the width of the sill bracket within which a head of a bolt may be disposed, with a stem of the bolt extending outward therefrom, allowing the bolt to slide along the bolt groove, and wherein the bolt extends through the hurricane shutter to secure the hurricane shutter. The hurricane shutter comprises a substantially rectangular panel like member having a narrow inwardly projecting surface and a wide inwardly projecting surface, wherein an elongated hole is positioned along a bottom edge of the wide inwardly projecting surface to allow for horizontal width adjustment of the hurricane shutters when at least two of the hurricane shutters overlap with a stem of the bolt penetrating the elongated hole, and wherein the bolts slide along the bolt groove for horizontal width adjustment of the hurricane shutters.

In an alternate embodiment, the outer face includes a plurality of studs, spacedly secured, wherein a stem of each of the studs extends outward therefrom, and wherein the stem extends through the hurricane shutter to secure the hurricane shutter, and wherein a lock bar prevents the studs from becoming dislodged.

An alternate embodiment of the integrated window construction system for mounting both sheet glass windows and hurricane shutters within a window frame, comprises two brackets comprising a window bracket portion and an outer face on an exterior side of the window bracket portion, wherein the outer face comprises a means for securing at least one shutter to the outer face between the brackets, the brackets fastened opposite each other within the window frame. The window bracket portion is substantially rectangular in shape, having a top side, a bottom side, an interior side, and the exterior side, wherein the top side is positioned adjacent to the window frame for mounting, the window bracket portion further comprising a notch in the bottom of the window bracket portion extending along the length of the bracket between the interior side and the exterior side for insertion of an edge of the sheet of glass wherein a pair of grip arms within the notch secure the sheet of glass in place, the notch positioned such that a space is left between the sheet of glass and the hurricane shutter. The outer face comprises a bolt groove along the width of the bracket within which a head of a bolt may be disposed, with a stem of the bolt extending outward therefrom, allowing the bolt to slide along the bolt groove, and wherein the bolt extends through the hurricane shutter to secure the hurricane shutter. The hurricane shutter comprises a substantially rectangular panel like member having a narrow inwardly projecting surface and a wide inwardly projecting surface, wherein an elongated hole is positioned along a top and bottom bottom edge of the wide inwardly projecting surface to allow for horizontal width adjustment of the hurricane shutters when at least two of the hurricane shutters overlap with a stem of the bolt penetrating the elongated hole, and wherein the bolts slide along the bolt groove for horizontal width adjustment of the hurricane shutters.

In an alternate embodiment, the outer face comprises a plurality of studs, spacedly secured, wherein a stem of each of the studs extends outward therefrom, and wherein the stem extends through the hurricane shutter to secure the hurricane shutter, and wherein a lock bar prevents the studs from becoming dislodged.

An alternate embodiment of the integrated window construction system for mounting both window units and folding hurricane shutters between a window header and a window sill, comprises a header guide assembly fastened to the window header comprising a window header bracket portion and a upper shutter bracket portion spacedly connected by an extended member, the extended member defining a space between the window units and the folding hurricane shutters; and a sill guide assembly fastened to the window sill comprising a lower shutter bracket portion spacedly connected to a window sill bracket portion by an extended section, the extended section defining a space between the window units and the folding hurricane shutters. The upper shutter bracket portion of the header guide assembly comprises a horizontal header mount for attaching the upper shutter bracket portion to the header and a vertical retainer arm for retaining a removable header track. The removable header track comprises an inner compartment for housing wheels of the folding hurricane shutter and an outer compartment having an outer face, wherein the outer face provides a surface upon which upper rollers of the folding hurricane shutters can rest when in a closed position. The lower shutter bracket portion comprises a vertical retainer support attached to a horizontal sill mount, the horizontal sill mount comprising a means to attach a removable sill retainer lock, whereby once in place, the sill retainer lock provides an inner track guide space between the vertical retainer support and the removable sill retainer lock for accepting guide rollers of the folding hurricane shutters. The window header bracket portion comprises an upper window bracket and the window sill bracket portion comprises a lower window bracket for retaining a window unit.

In an alternate embodiment, the window header bracket portion comprises an upper sliding glass door bracket and the window sill bracket portion comprises a lower sliding glass door bracket for retaining a sliding glass door unit.

In an alternate embodiment, the window header bracket portion comprises an upper sheet glass bracket and the window sill bracket portion comprises a lower sheet glass bracket for retaining a sheet of glass.

Accordingly, it is an object of the present invention to provide an integrated window construction system for mounting both window units and storm shutter panels eliminating the need for the extra step of shutter bracket installation, thereby saving time and costs.

It is another object of the present invention to provide a bolt groove along the width of the sill bracket within which a head of a bolt may be disposed, with a stem of the bolt extending outward therefrom for attaching the shutter panel, allowing the bolt, or the bolt attached to the shutter panel, to slide along the bolt groove.

Accordingly, it is a feature of the invention to provide a horizontal bracing cap on the window header bracket portion of the header bracket and the sill bracket which slidably adjusts to accept windows of various depths.

An advantage of the invention is that the upper shutter bracket portion of the header bracket, includes an inner grip and an outer grip extending vertically downward, wherein each grip includes a flared lower portion to ease insertion of the shutter panel between the grips.

These and other objects, features, and advantages of the present invention may be more clearly understood and appreciated from a review of the following detailed description of the disclosed embodiments and by reference to the appended drawings and claims.

BRIEF DESCRIPTION OF THE DRAWING FIGURES

FIG. 1*a* is a front elevated view of a preferred embodiment of the window construction system with an installed hurricane shutter according to the invention.

FIG. 1*b* is a cross-sectional view of the preferred embodiment of the window construction system with an installed hurricane shutter according to the invention.

FIG. 2*a* is a front elevated view of the hurricane shutter according to the invention.

FIG. 2*b* is a cross-sectional view of the hurricane shutter according to the invention.

FIG. 3*a* is a front elevated view of a plurality of overlapping hurricane shutters installed according to the invention.

FIG. 3*b* is a cross-sectional view of a plurality of overlapping hurricane shutters installed according to the invention.

Figure 12A:
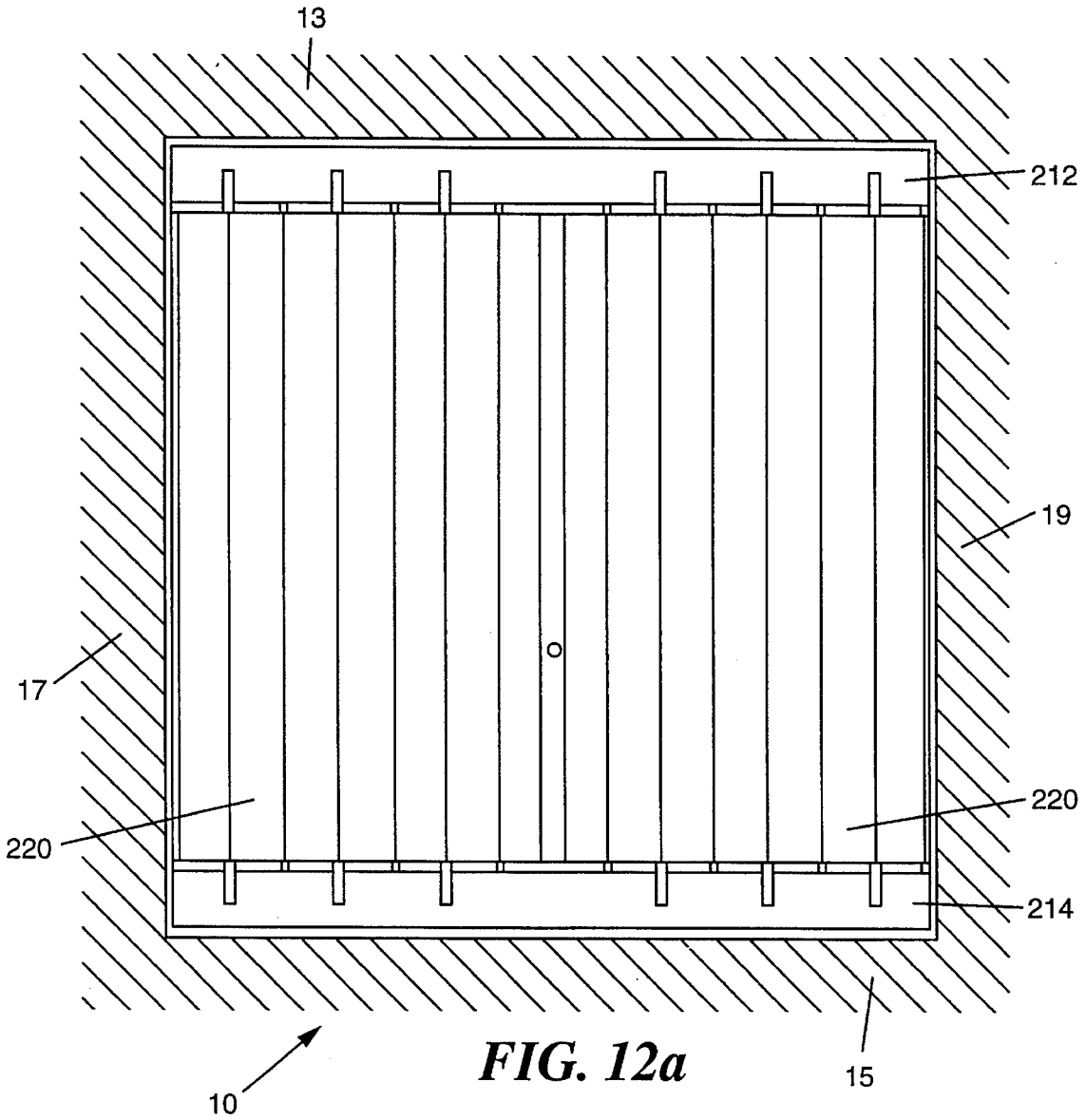

FIG. 12*a* is a front elevated view of an alternate embodiment of the window construction system incorporating folding hurricane shutters according to the invention.

Figure 12B:
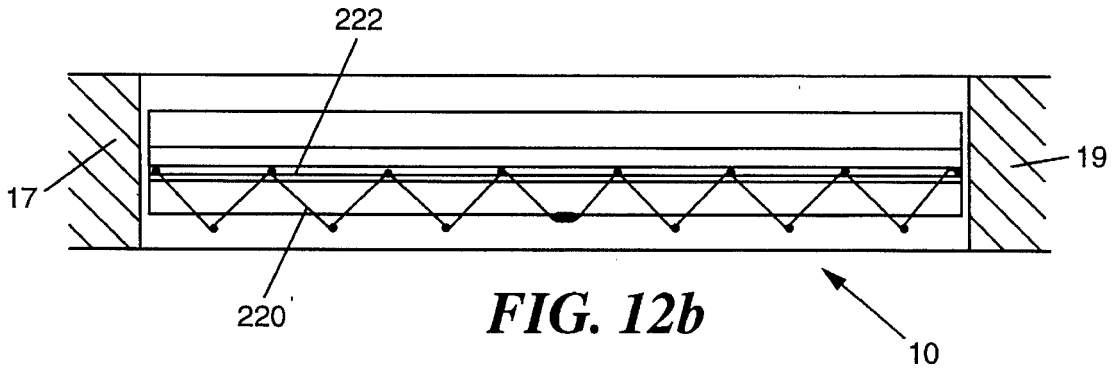

FIG. 12*b* is a cross-sectional view of an alternate embodiment of the window construction system incorporating folding hurricane shutters according to the invention.

Figure 13:
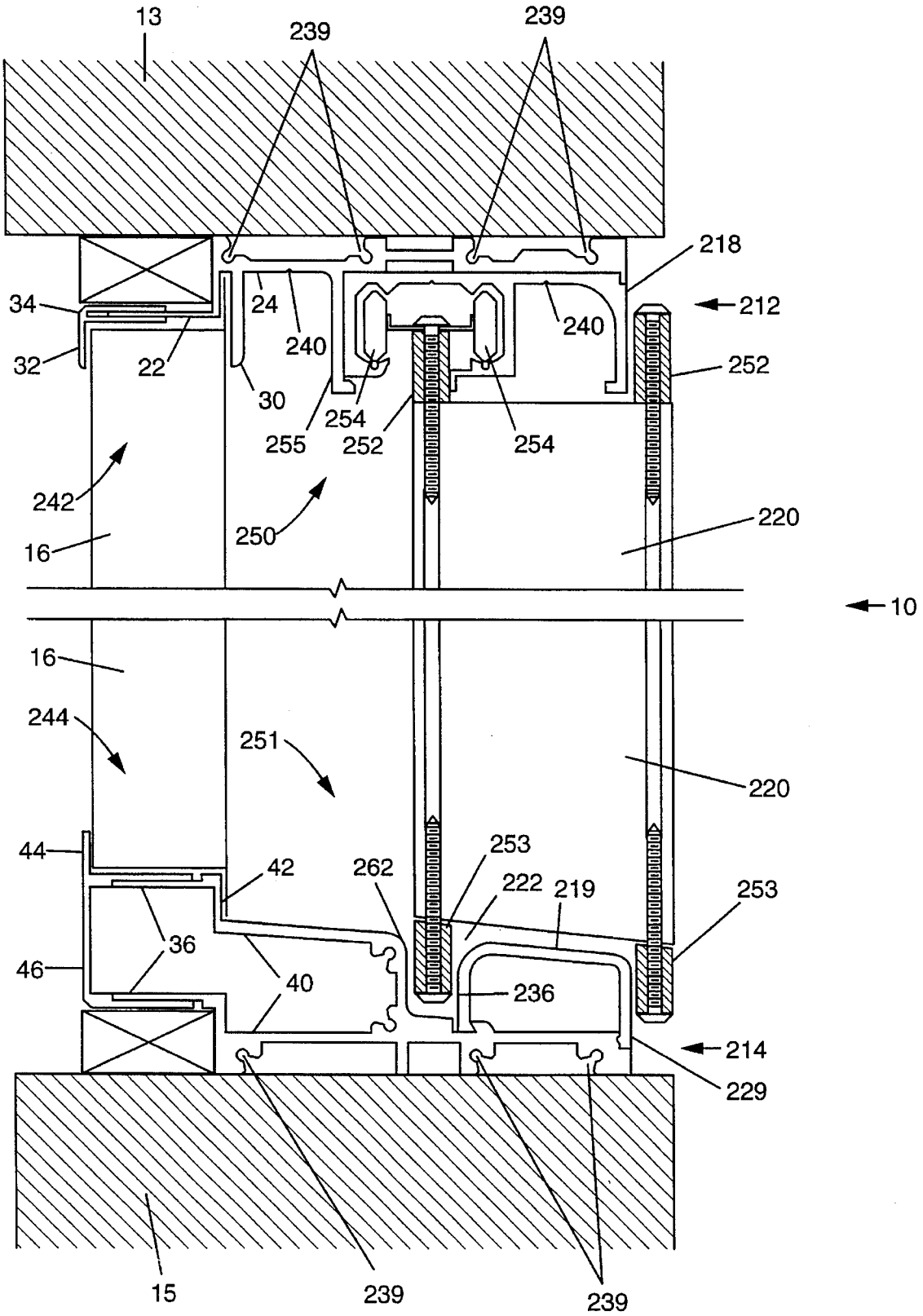

FIG. 13 is a cross-sectional view of an alternate embodiment of a window construction system showing a folding hurricane shutter mounted to a window unit according to the invention.

Figure 14A:
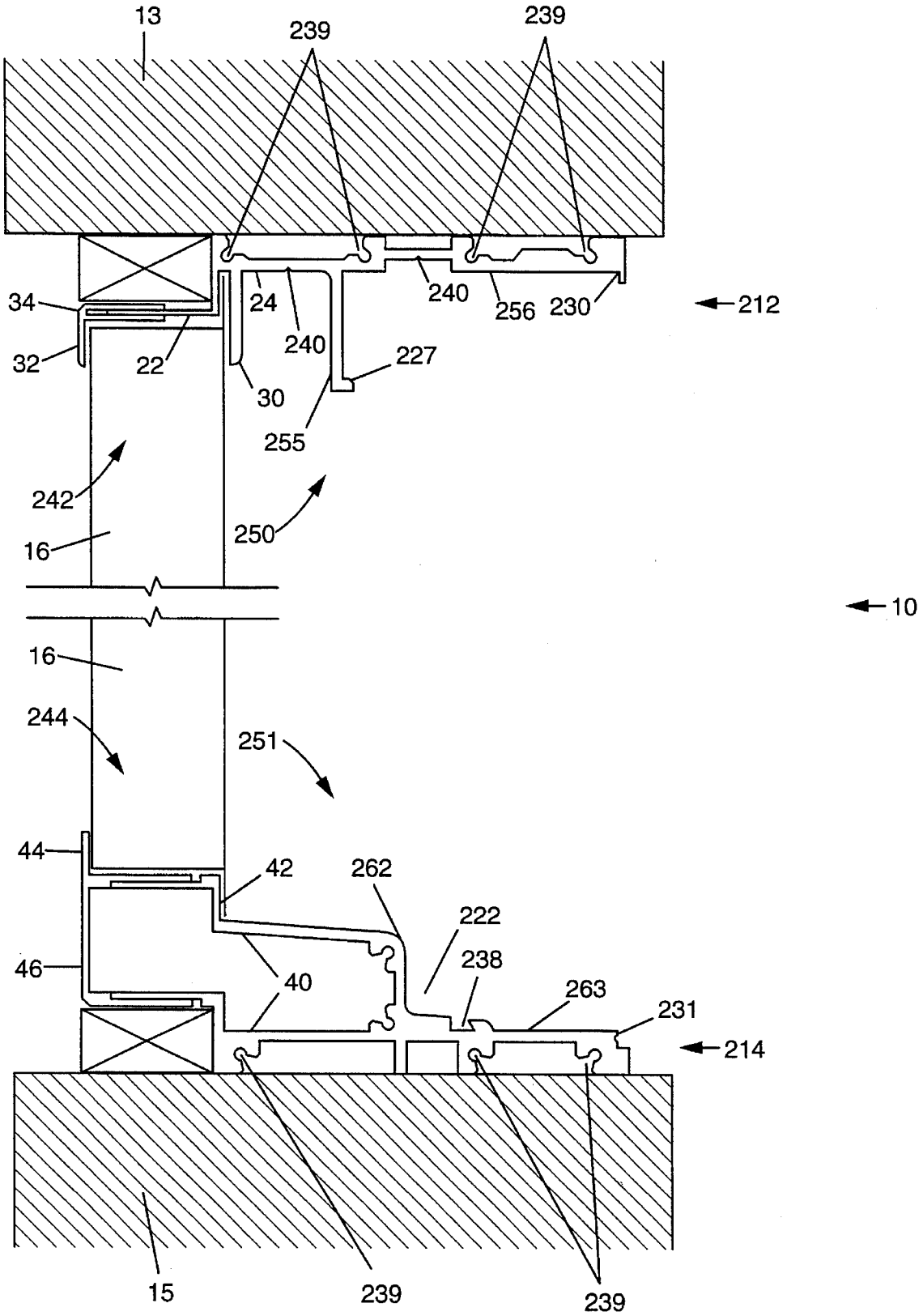
Figure 14B:
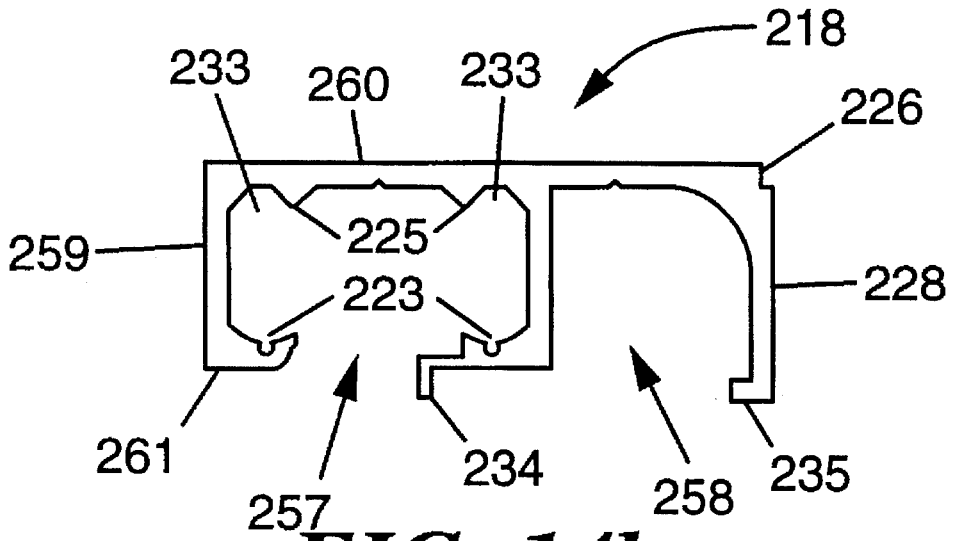
Figure 14C:
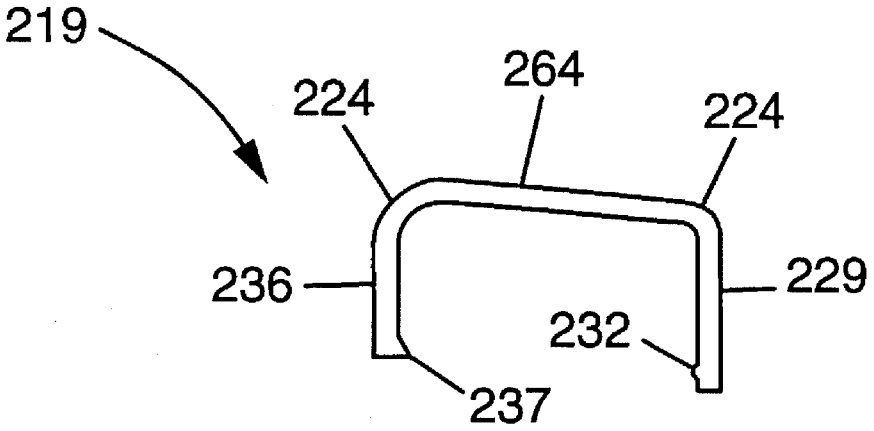

FIG. 14 is a cross-sectional exploded view of an alternate embodiment of a window construction system showing a folding hurricane shutter mounted to a window unit according to the invention.

Figure 15:
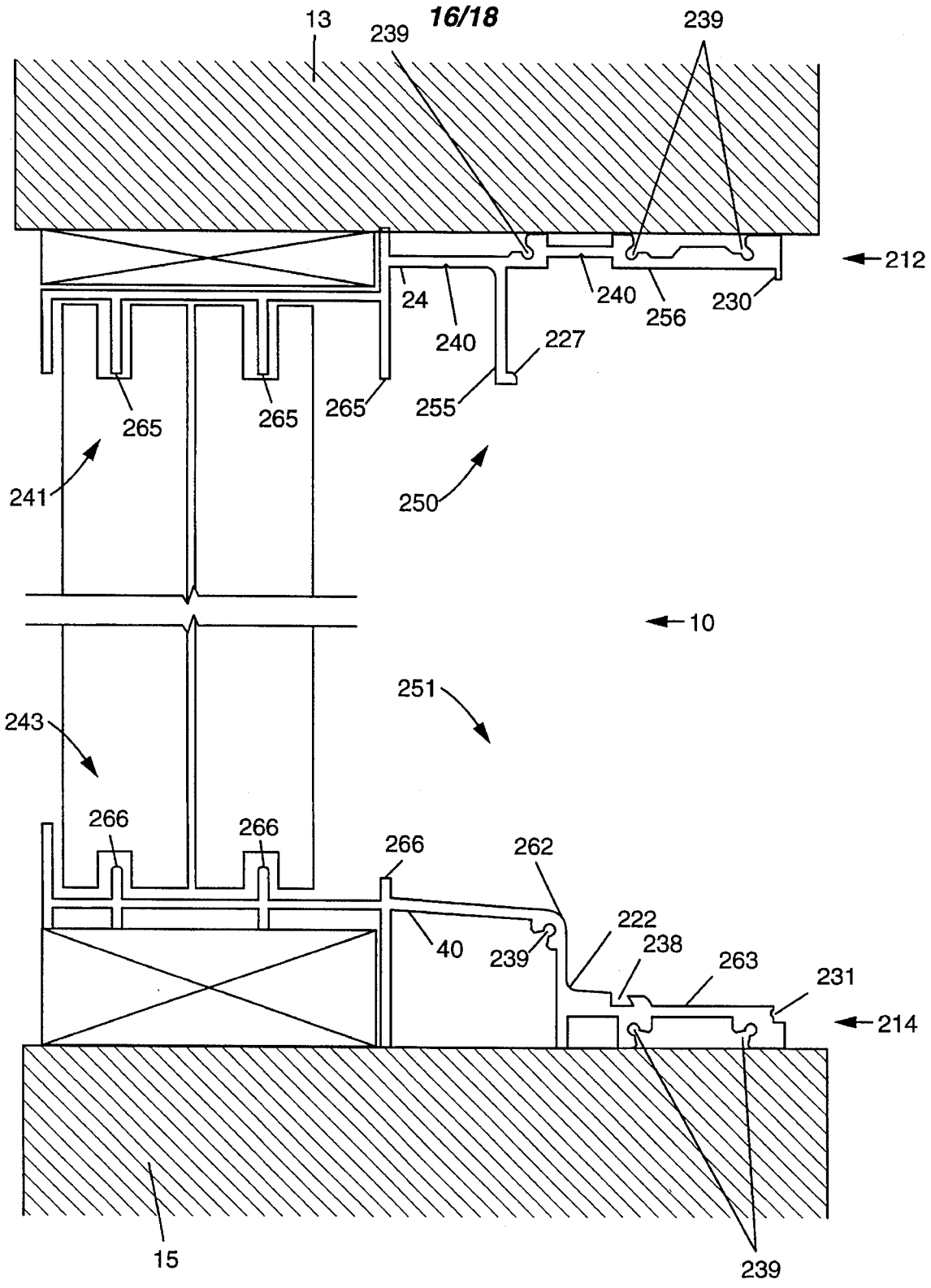

FIG. 15 is a cross-sectional exploded view of an alternate embodiment of a window construction system showing a folding hurricane shutter mounted to a sliding glass door unit according to the invention.

Figure 16:
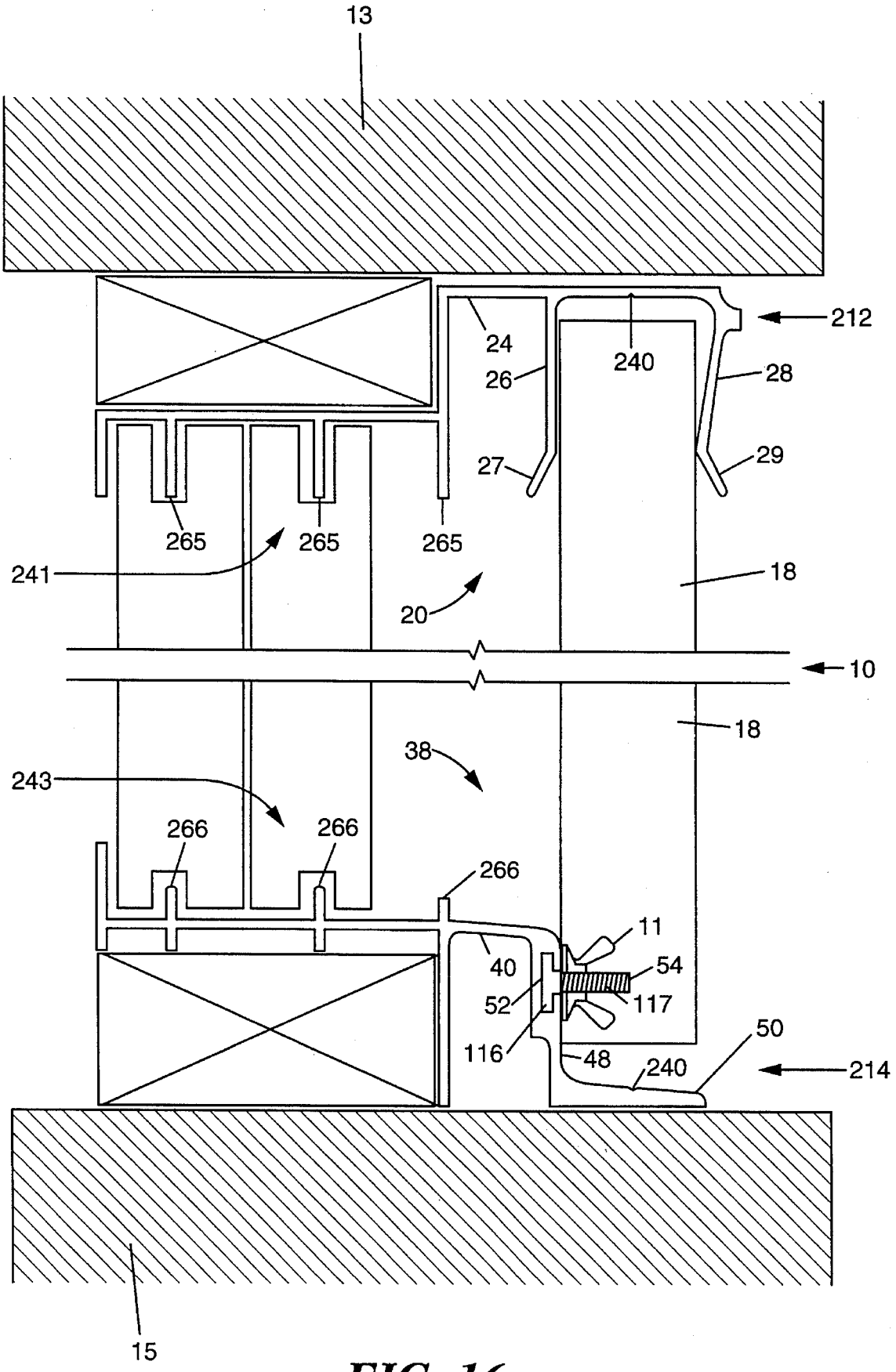

FIG. 16 is a cross-sectional view of an alternate embodiment of a window construction system showing a hurricane shutter mounted with sliding bolts to a sliding glass door unit according to the invention.

Figure 17:
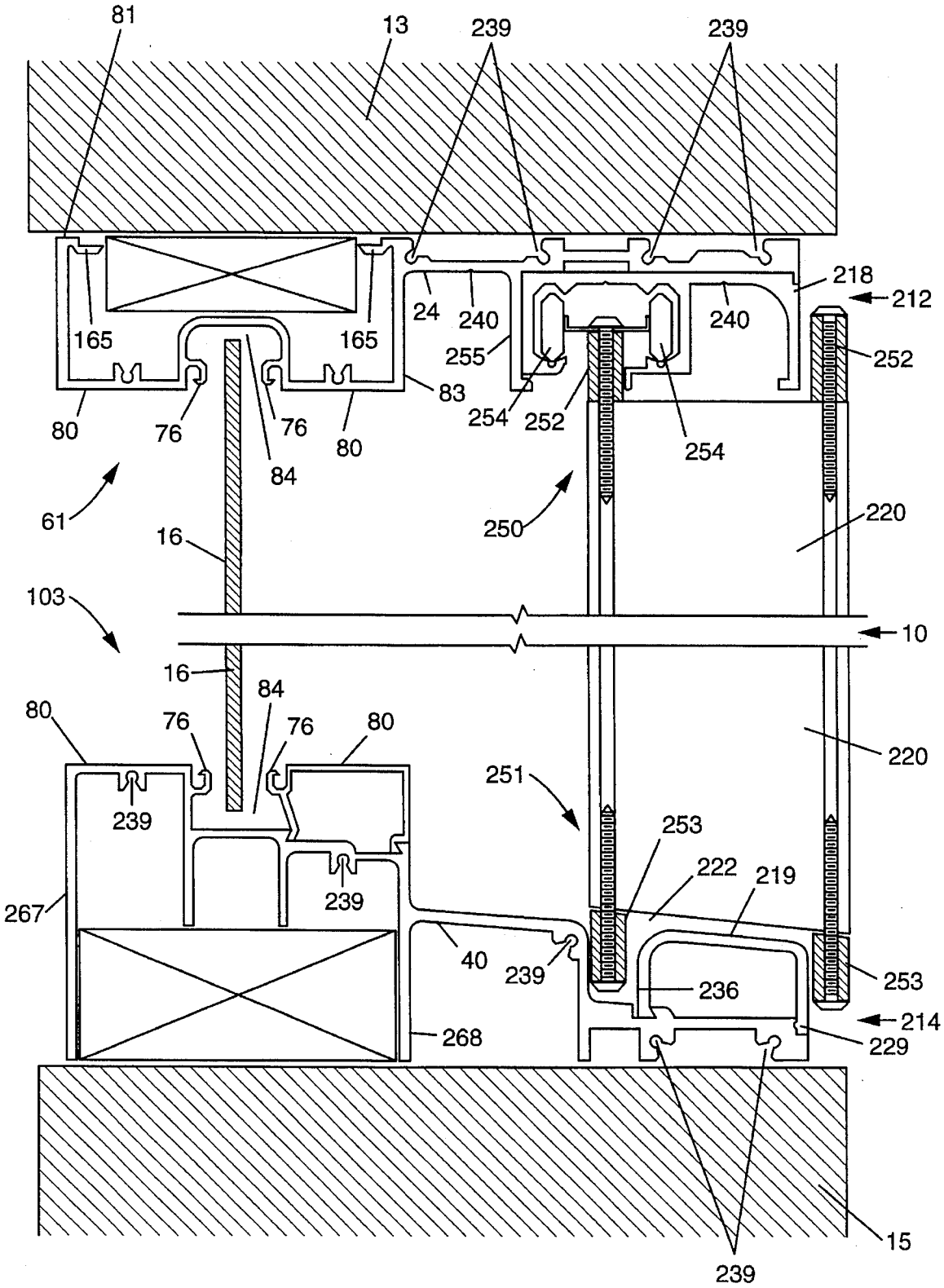

FIG. 17 is a cross-sectional view of an alternate embodiment of a window construction system showing a folding hurricane shutter mounted to a store front sheet glass window unit according to the invention.

DETAILED DESCRIPTION OF THE PREFERRED EMBODIMENT

Figure 1A:
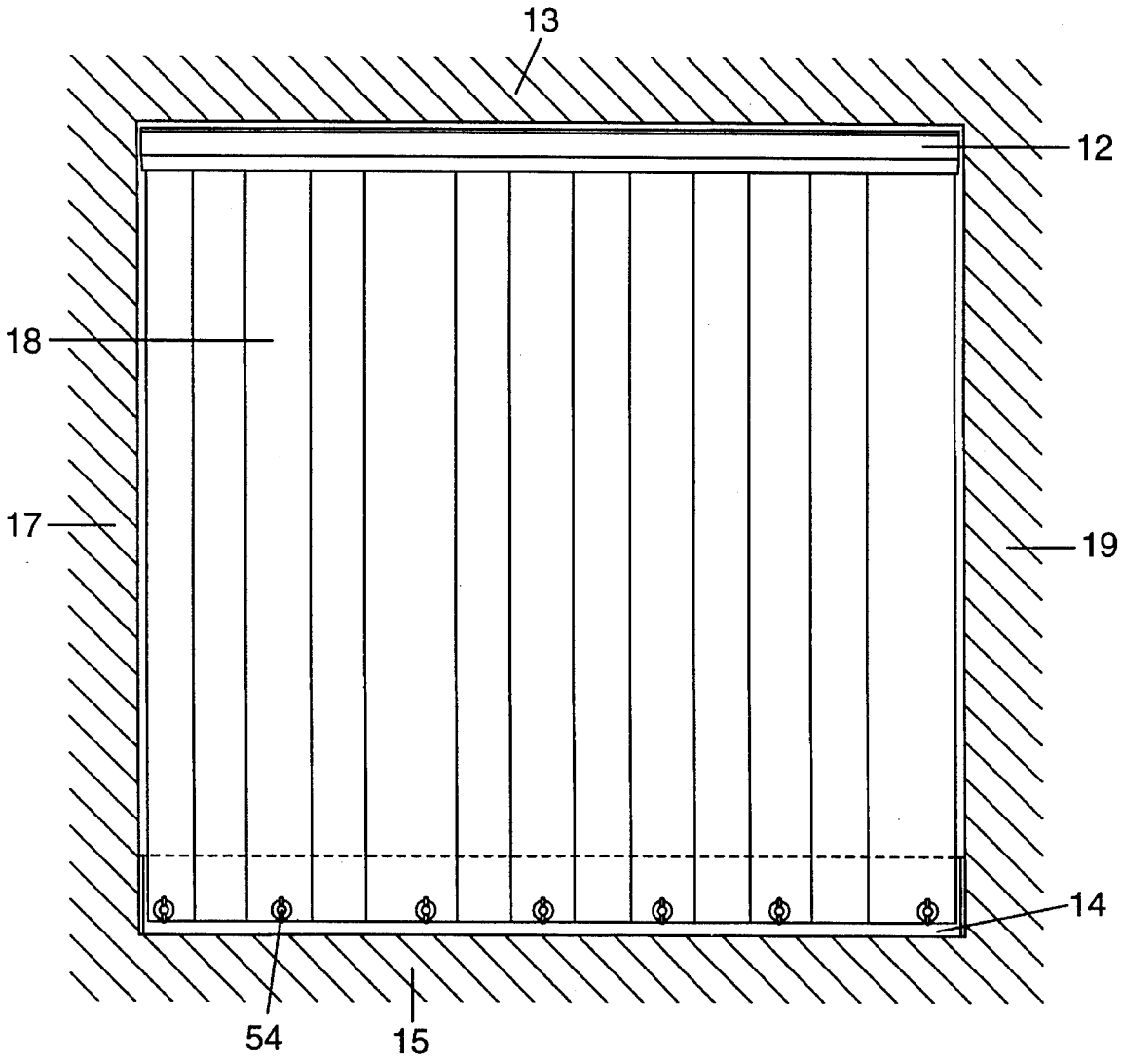
Figure 1B:
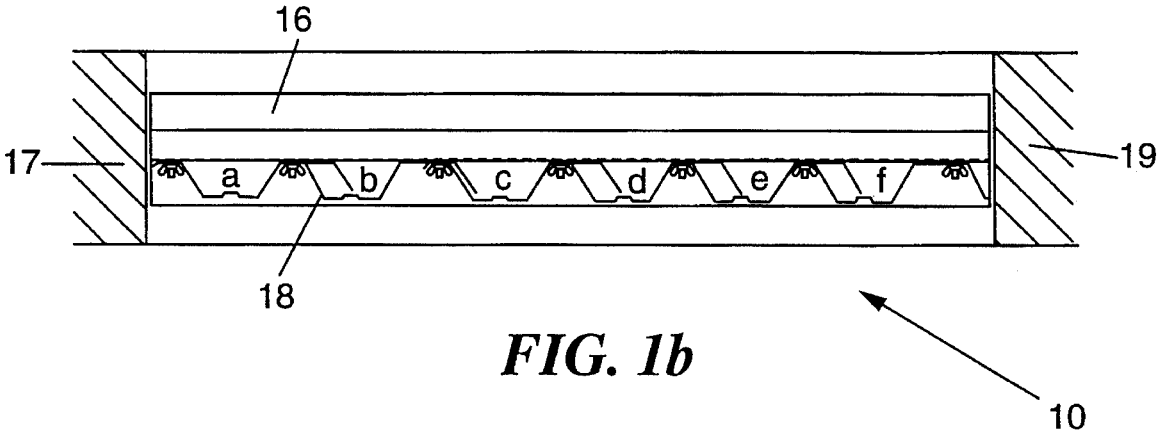

Turning now to FIGS. 1*a* and 1*b*, the hurricane storm shutter 18 of the preferred embodiment of the invention is shown. In FIG. 1*a* the storm shutter 18 is shown in a front elevated view. FIG. 1*b* shows the top view. The hurricane storm shutters 18 are used to protect windows, store fronts, sliding glass doors, and the like by mounting the shutters 18 between the upper header 13, lower sill 15, and side jams 17, 19. The hurricane storm shutter 18 attaches to an upper header bracket 12 and to a lower sill bracket 14. Each separate hurricane storm shutter 18 is designed such that it may overlap the next with the ability to slide to a greater or lesser percent of overlap. Shutter 18*a*, 18*b*, 18*d*, 18*e* and 18*f* are positioned toward the left. Shutter 18*c* is positioned toward the right at the maximum adjustment in width. The ability to adjust over the adjacent shutter allows a row of shutters 18 to fit any width measurement, thus they can fit into a confined space without constricting custom width or special dimensioned shutters. The elongated hole 9 and wider surface space allows the overlapping shutter 18 to be adjusted to the desired width. The window construction system is usually recessed into a confined space either by jams or adjacent walls.

Figure 2A:
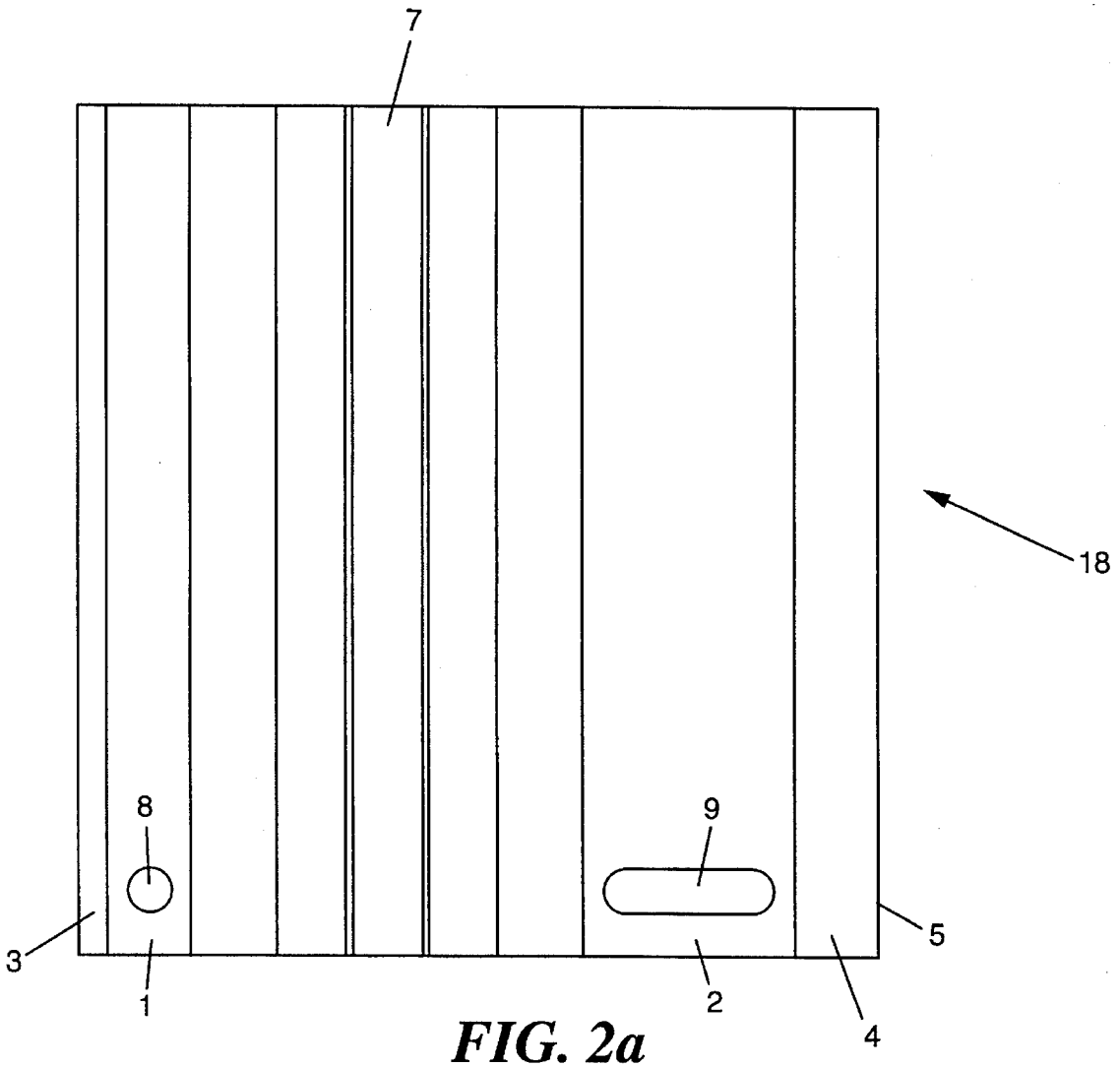
Figure 2B:
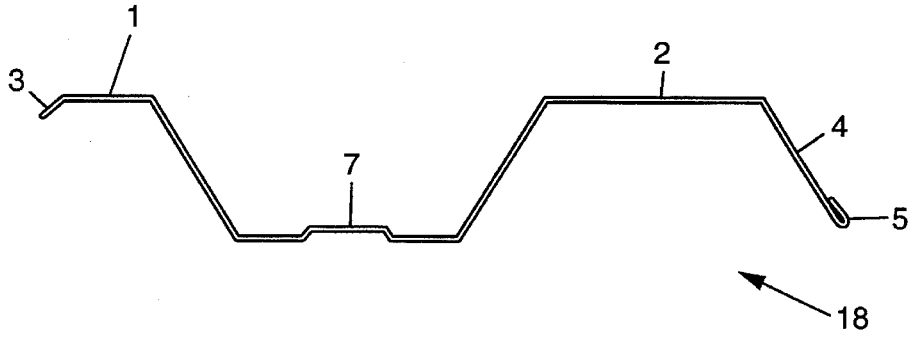
Figure 4:
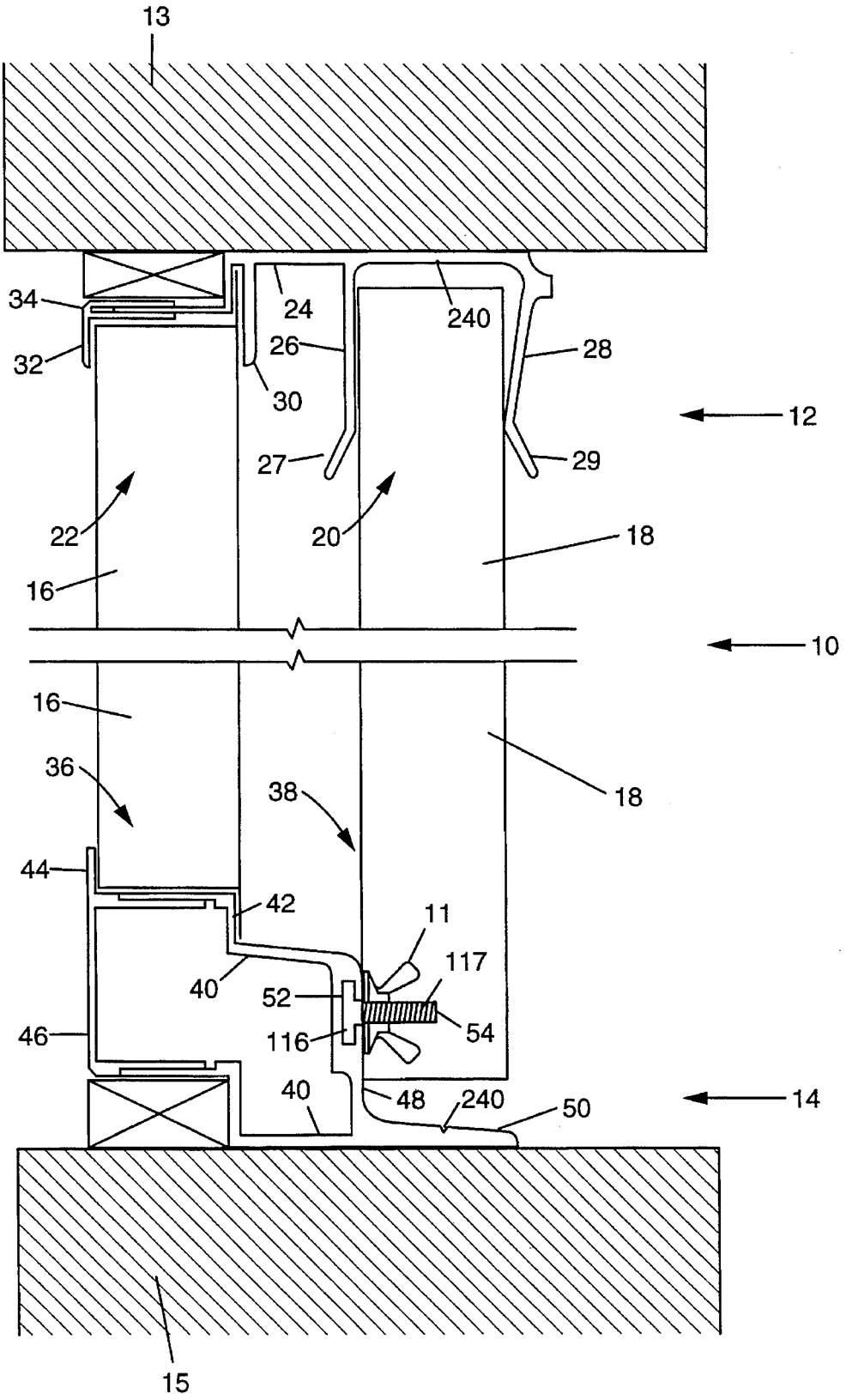
FIG. 4 is a cross-sectional view of a preferred embodiment of the window construction system showing a hurricane shutter mounted with sliding bolts to a window unit according to the invention.

FIG. 2*a* is a front elevated and FIG. 2*b* is a top view of a single hurricane storm shutter 18. As shown in FIG. 4, a bolt 54 and wing nut 11 can attach the shutter 18 or shutters when overlapped to a lower sill bracket 14. The heads of the bolts 116 can travel horizontally in the lower sill bolt groove 52, adjusting to the various positions of overlapping hurricane shutters 18.

The hurricane storm shutter 18 has a narrower inwardly projecting surface 1 with a single round hole 8. The opposite side of hurricane storm shutter 18 is a wider inwardly projecting surface 2 with an elongated hole 9. The hurricane storm shutter 18 has a small outer lip 3, larger outer lip 4, return strengthening lip 5 and an outwardly projecting surface with strengthening ridges 7.

When used in conjunction with the storm shutter system 10, (FIG. 4) the shutter 18 and window unit 16 are both mounted between a header bracket 12 and a sill bracket 14. The header bracket 12 is mounted on the window header 13 and the sill bracket 14 is mounted to the sill 15. The side with the elongated hole 9 is much wider than the side with the round hole 8. When one hurricane storm shutter 18 overlaps the other, the second shutter 18 can slide to the right or left within the range of the elongated hole 9. The bolt penetrates the elongated hole 9 and round hole 8 securing both together, and then to the lower sill 15. There is a small outer lip 3 and a larger lip 4 with a return 5 on the other side. The return 5 on the larger lip 4 is used to strengthen the lip and to shorten the lip so the adjacent panel can slide for width adjustments across the larger lip 4 without contacting the lip.

Figure 3A:
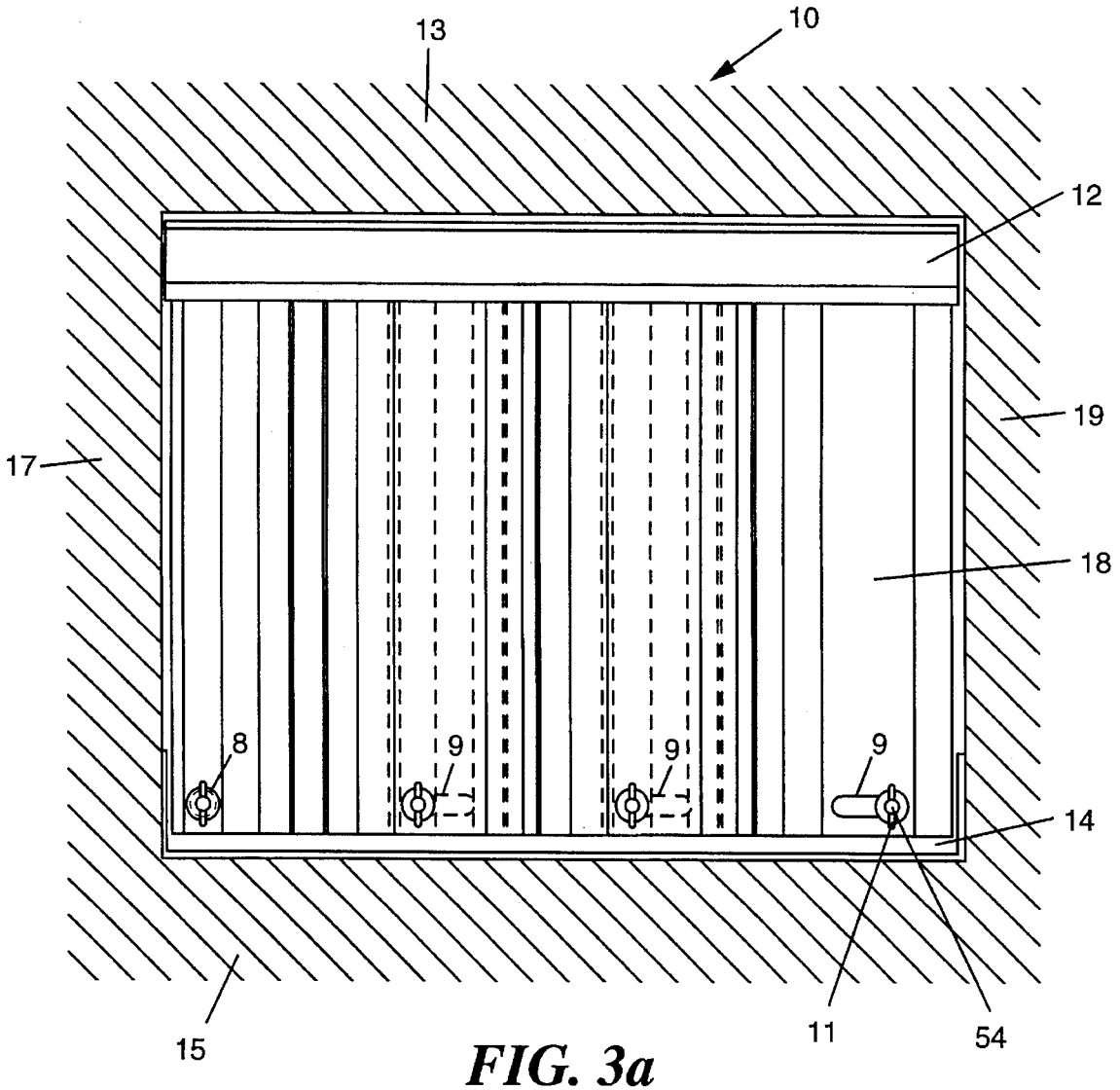
Figure 3B:
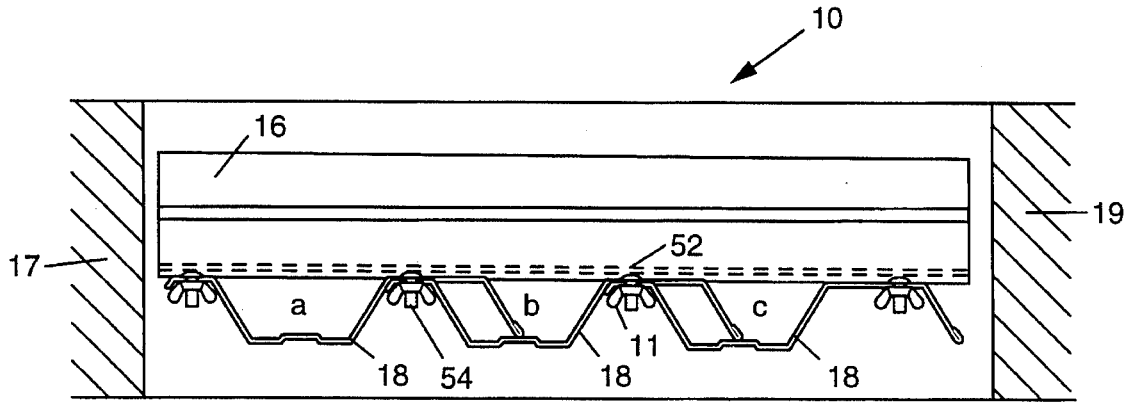

FIG. 3*a* is the front elevated view and FIG. 3*b* is the top view of three overlapping hurricane storm shutters, 18*a*, 18*b*, and 18*c* with the bolts 54 and wing nuts 11 in place in the preferred embodiment of the window construction system according to the invention. FIG. 3*b* shows the cross-section of the storm shutter system 10, with the hurricane shutters 18*a*, 18*b*, and 18*c* positioned between the left jam 17 and the right jam 19. The back of the hurricane storm shutter 18, to the right and left of the center protrusion, are of different widths. Referring to FIGS. 2*a* and 2*b*, the side with the elongated hole 9 is much wider than the side 1 with the round hole 8.

When one hurricane storm shutter 18*a* overlaps a second 18*b*, the second 18*b* can slide to the right or the left within the range of the elongated hole 9. The bolt 54 penetrates the elongated hole 9 and round hole 8 securing the shutters 18*a*, 18*b*, together and securing the shutters 18*a*, 18*b* to the lower sill 15. There is a small outer lip 3 and a larger lip 4 with a return 5 on the other side. The return 5 on the larger lip 4 is used to strengthen the lip 4 and to shorten the lip 4 so the adjustment panel can slide for width adjustments across the larger lip 4 without contacting the lip 4.

Turning now to FIG. 4, a cross sectional view of the preferred embodiment of the window construction system is shown. The upper window header bracket 12 will accept the upper end of the hurricane storm shutter 18 and the inner portion of the upper window bracket 12 will accept the upper portion of most standard window units 16. The inner portion of the lower bolt groove sill bracket 14 will accept the lower portion of most standard window units 16. The outer portion of the lower bolt groove sill bracket 14 will hold the lower portion of the hurricane storm shutter 18.

The header bracket 12 comprises a shutter bracket portion 20 and a window bracket portion 22 spacedly connected by an extension arm 24. The extension arm 24 provides the spacing between the window unit 16 and the shutter 18.

The shutter bracket portion 20 of the header bracket 12, which extends toward the exterior of the building, spaced apart from the window bracket portion 22 by the extension arm 24, includes an inner grip 26 and an outer grip 28 extending vertically downward. The inner grip 26 and the outer grip 28 both include a flared lower portion 27, 29 to ease insertion of the shutter 18 between the grips 26, 28.

The window bracket portion 22 of the header bracket 12 includes a front grip 30 and a rear grip 32 for retaining the window unit 16. The window bracket portion 22 includes a horizontal bracing cap 34 between the front and rear grips 30, 32 which is slidably adjustable to accept windows of various depths. The bracing cap 34 is designed with a vertical drop from the top edge of the header bracket 12 to allow a proper fit over standard wood jam.

The sill bracket 14 comprises a window bracket portion 36 and a shutter bracket portion 38 connected by an extension section 40 which provides the spacing between the window unit 16 and the shutter 18. The window bracket portion 36 of the sill bracket 14 includes a front edge 42 and a raised rear lip 44 for retaining the window unit 16. The window bracket portion 36 includes a horizontal bracing cap 46 between the front edge 42 and a raised rear lip 44 which is slidably adjustable to accept windows of various depths.

The shutter bracket portion 38 of the sill bracket 14 comprises an outer face 48 which extends vertically upward from the window sill 15 and a lower exterior horizontal lip 50 which rests on the window sill 15. The outer face 48 includes a bolt groove 52 along the width of the sill bracket 14 whereby a bolt 54 or the like may slide along the width of the sill bracket 14 with the head 116 of the bolt 54 disposed in the bolt groove 52 and the stem 117 of the bolt 54 extending outward therefrom. The exterior lip 50 is preferably constructed with a 5° slope with a radius ascending to the bolt groove to allow water to flow off the lip 50. A drill point score line 240 runs the entire length of the lip for the installation of fasteners according to municipal code.

The bolt groove 52 allows the horizontal adjustment of a bolt 54 with wing nut 11 which secures the hurricane storm shutter 18 of different spacing widths to the lower sill bracket 14. The adjustment of the bolt 54 will allow a variety of storm shutters 18 produced by trade to fit the window construction system 10. The width and depth of different hurricane storm shutter manufactured may require the width of the upper hurricane storm shutter bracket to vary. The varying width of hurricane storm shutters produced by trade would only require the horizontal re-alignment of the bolt 54 in the bolt groove 52. The bolt 54 has a square head 116 so it will not rotate as the wing nut 11 is tightened or loosened. A notch is cut into the upper lip of the bolt groove 52 so the bolt 54 can be inserted into the bolt groove 52. As in most installations, the bolt groove is blocked at each end by obstructions, such as jams or adjacent walls 17, 19.

The storm shutter system 10 is preferably installed into a formed window having a header 13 and sill 15 by inserting the sill bracket 14 along the sill 15, inserting the header bracket 12 along the header 13, and then placing the window unit 16 between the two brackets 12, 14. The sill bracket 14 is attached to the sill 15 and the header bracket 12 is attached to the header 13. The window unit 16 is then attached to the window bracket portions 22, 36 of the header bracket 12 and sill bracket 14.

The shutters 18 are then installed in the following manner. The upper edge of the shutter 18 is inserted into the shutter bracket portion 20 of the header bracket 12 between the inner grip 26 and the outer grip 28, with the flared lower portions 27, 29 easing the insertion. The lower edge of the shutter 18 is pressed against the outer face 48 of the sill bracket 14 letting the stem of the bolts 54 penetrate slots in the shutter. The number of bolts 54 will vary depending on the width of the window to be covered, the number of shutter panels 18, and the spacing between the slots on each shutter panel. The bolts 54 can be removed during storage and installed during the installation of the shutter panels 18. The bolts 54 are designed to slide the full length of the sill bracket 14 to allow for positioning the bolts in line with the slots in the shutter panels 18. Prior to tightening the bolts 54, the shutter panels 18 can be slid along the header and sill brackets 12, 14 to the desired position.

Figure 5:
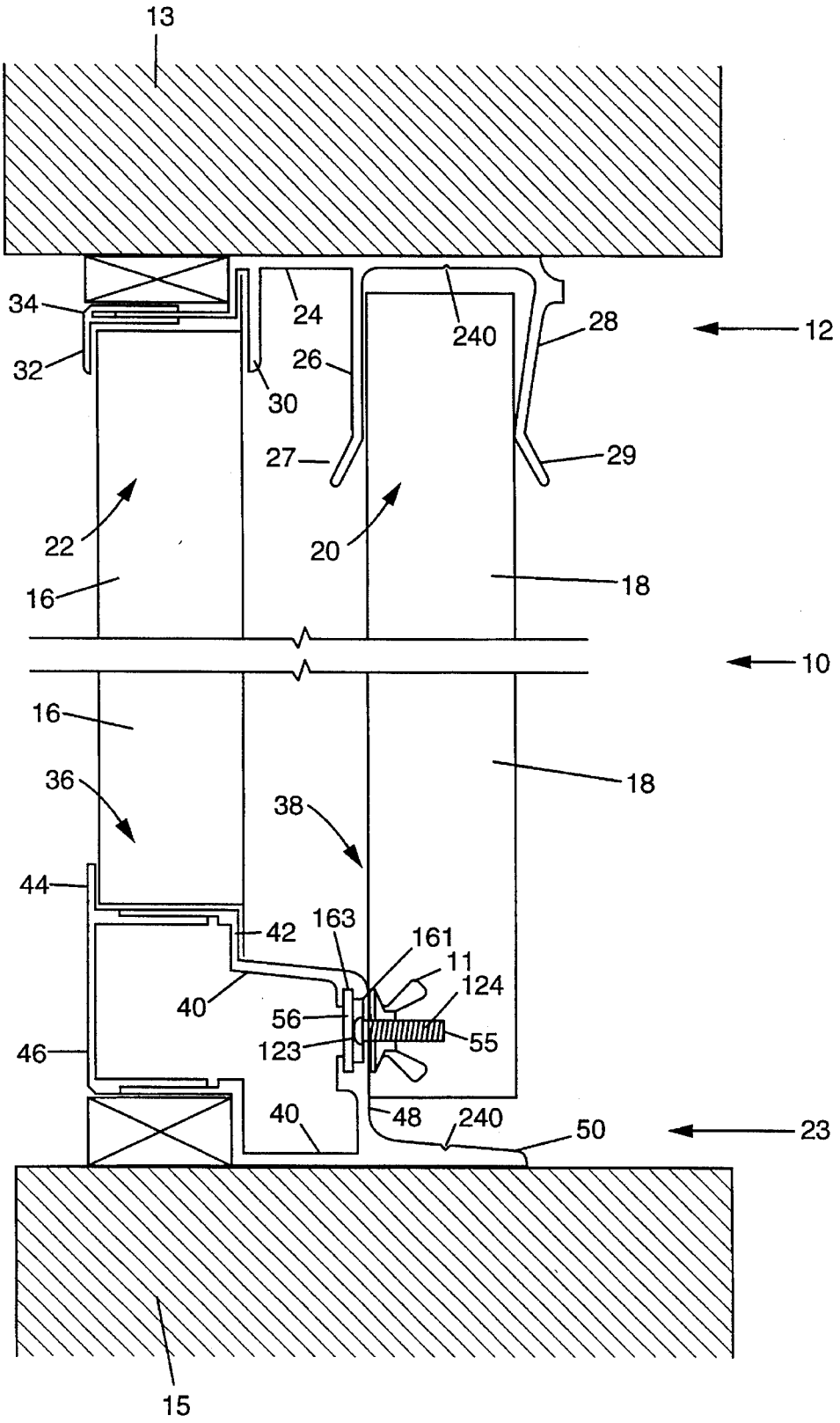
FIG. 5 is a cross-sectional view of an alternate embodiment of the window construction system showing a hurricane shutter mounted with studs to a window unit according to the invention.

Turning now to FIG. 5 an alternate embodiment of the window construction system 10 incorporating a stud-lock sill bracket 23 in place of the sill bracket 14 of FIG. 4. As in the embodiment shown in FIG. 4, the upper window header bracket 12 will accept the upper end of the hurricane storm shutter 18 and the inner portion of the upper window header bracket 12 will accept the upper portion of most standard window units 16.

The stud-lock sill bracket 23 comprises a window bracket portion 36 and a shutter bracket portion 38 connected by an extension section 40 which provides a spacing between the window unit 16 and the shutter 18. The window bracket portion 36 of the stud-lock sill bracket 23 is the same as the window bracket portion 36 described with reference to FIG. 4.

The stud-lock sill bracket 23 uses a permanent stud 55 configuration which does not slide. The permanent stud has a locking mechanism 56 to prevent the stud from falling into the space between the window and shutters. Behind the stud 55 there is a space 161 which allows clearance for the insertion of the lock bar 56 in the top and bottom grooves 163. The shutter bracket portion 38 of the stud-lock sill bracket 23 comprises an outer face 48 which extends vertically upward from the window sill 15 and a lower exterior horizontal lip 50 which rests on the window sill 15. The outer face 48 includes a centering line along the width of the stud-lock sill bracket 23 whereby the stud 55 may be projected through and extended outward through the outer face 48. The exterior lip 50 is preferably constructed with a 5° slope with a radius ascending to the stud line to allow water to flow off the lip 50. A drill point score line 240 runs the entire length of the lip for the installation of fasteners according to municipal code.

The outer portion of the lower stud-lock sill bracket 23 will hold the lower portion of the hurricane storm shutters 18. The horizontal placement of the studs 55 is pre-determined according to the spacing required by the hurricane storm shutters 18 to fill the horizontal dimension required. Studs 55 are placed in the lower stud-lock sill bracket 23 and then secured into place by an additional lock bar 56. The width and depth of different hurricane storm shutters manufactured may require the width of the upper hurricane storm shutter bracket 20 to vary. A varying width dimension of the hurricane storm shutter 18 also requires the stud spacing to alter. The studs 55 must be pressed into place prior to the insertion of the lock bar 56. In most installations, the stud-lock sill bracket 23 is blocked at each end by obstructions, either jams or adjacent walls 17, 19.

The storm shutter system 10 is preferably installed similar to that shown in FIG. 4. The system 10 is installed into a formed window having a header 13 and sill 15 by inserting the stud-lock sill bracket 23 along the sill 15, inserting the header bracket 12 along the header 13, and then placing the window unit 16 between the two brackets 12, 14. The stud-lock sill bracket 23 is attached to the sill 15 and the header bracket 12 is attached to the header 13. The window unit 16 is then attached to the window bracket portions 22, 36 of the header bracket 12 and stud-lock sill bracket 23.

The shutters 18 are then installed in the following manner. The upper edge of the shutter 18 is inserted into the shutter bracket portion 20 of the header bracket 12 between the inner grip 26 and the outer grip 28, with the flared lower portions 27, 29 easing the insertion. The lower edge of the shutter 18 is pressed against the outer face 48 of the stud-lock sill bracket 23 letting the stem of the stud 55 penetrate slots in the shutter. The number of studs 55 will vary depending on the width of the window to be covered, the number of shutter panels 18, and the spacing between the slots on each shutter panel. The studs 55 should not be removed during storage and are preferably installed during the manufacturing of the sill. The studs 55 are pre-spaced and run the full length of the sill bracket 14 to allow for positioning the studs in line with the slots in the shutter panels 18. Prior to tightening the studs 55, the shutter panels 18 can be slid along the header 12 and stud-lock sill bracket 23 to the desired position. Wing nut 11 is then tightened.

Figure 6:
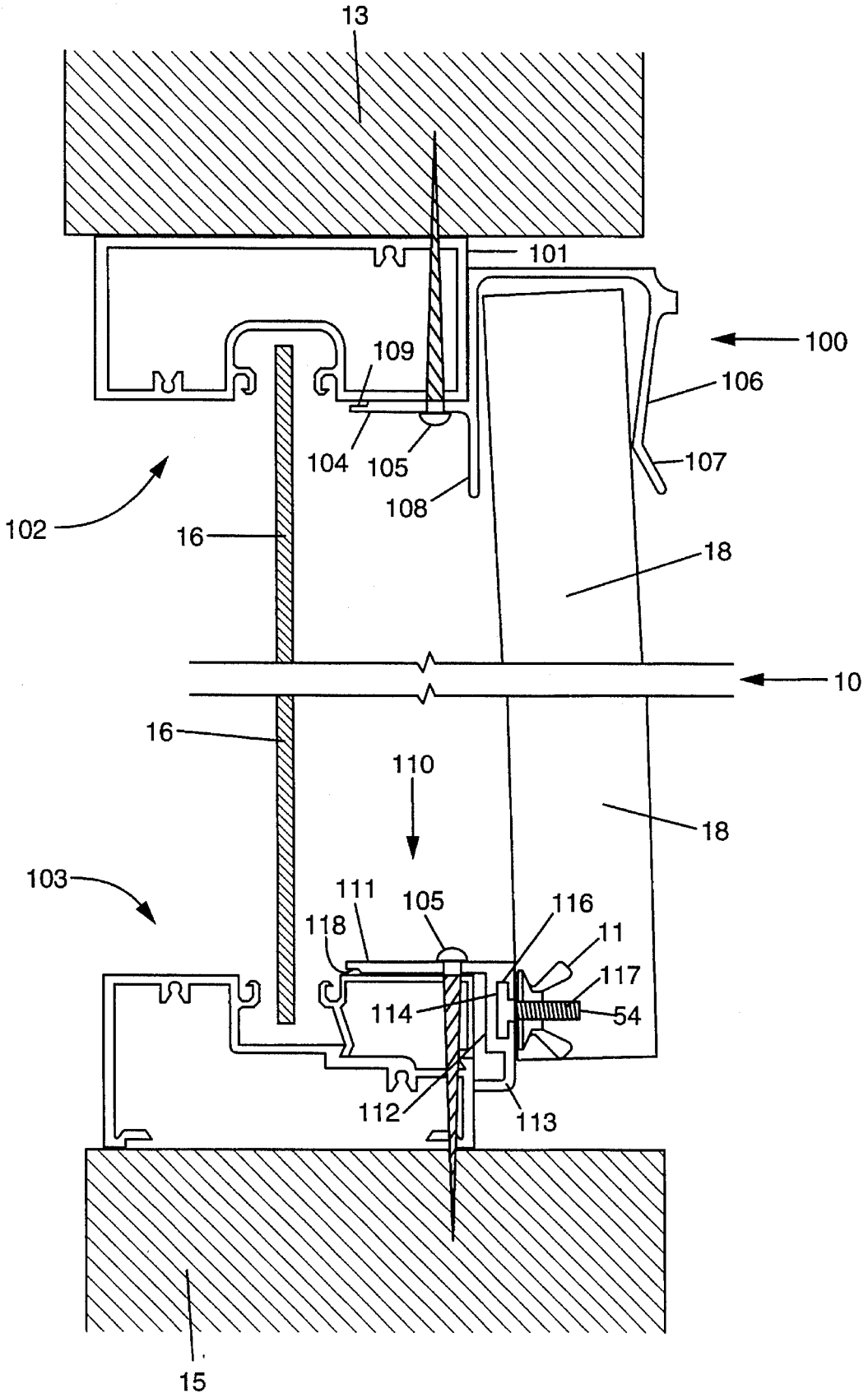
FIG. 6 is a cross-sectional view of an alternate embodiment of a retro-fitted window construction system showing a shutter mounted with sliding bolts to a store front sheet glass window unit according to the invention.

FIG. 6 is a cross sectional view of an alternate embodiment of the storm shutter system 10 which enables a shutter-conversion header bracket 100 and a shutter-conversion sill bracket 110 to be retro-fitted to an existing or new store front window installation. The shutter-conversion header bracket 100 attaches to the bottom and outer surface of the upper typical store front window header 102. The shutter-conversion sill bracket 110 attaches to the top and outer surface of the lower typical store front window sill 103. The bolt groove 114, similar to that shown in FIG. 4, allows the horizontal adjustment of a bolt 54 with wing nut 11, which secures the hurricane storm shutter 18 of different spacing widths to the shutter-conversion sill bracket 110. The adjustment of the bolt 54 will allow a variety of storm shutters 18 produced by trade to fit the lower shutter-conversion sill bracket 110. The width and depth of different hurricane storm shutters manufactured may require the width of the shutter-conversion header bracket 100 to vary. And the greater or lesser width of hurricane storm shutters produced by trade would only require the horizontal realignment of the bolt 54 in the bolt groove 114. The bolt 54 has a square head so it will not rotate as the wing nut 11 is tightened or loosened. A notch is cut into the upper lip of the bolt groove 114 so the bolt 54 can be inserted into the bolt groove 114. As in most installations, the bolt groove 114 is blocked at each end by obstructions, such as by jams or adjacent walls 17, 19.

Once in place, this embodiment works to convert a window only header bracket into a combination window/shutter bracket, similar to the shutter bracket portion 20 of the header bracket 12 shown in FIG. 4. Generally the bracket is used on store front sheet glass window systems. This U-shaped shutter-conversion header bracket 100 is positioned against an exterior side 101 of a header bracket 102 and attached by a screw means 105 or the like through a horizontal mounting member 104 up into the window sill 13. The shutter-conversion header bracket 100 includes an outer grip 106 extending vertically downward including a flared lower portion 107 to ease insertion of the shutter 18, and an inner arm 108. The shutter 18 is inserted between the outer grip 106 and the inner arm 108. The lip 109 overlaps existing rubber window glazing to assure a water resistant seal.

The shutter-conversion sill bracket 110 includes a horizontal arm 111 attached to a right angle to a vertical arm 112. The horizontal arm 111 is attached to an existing sill bracket along the top exterior side by a screw means 105 or the like. The vertical arm 112 includes an outer face 113 which includes a bolt groove 114 along the width of the shutter-conversion sill bracket 110 whereby a bolt 54 may slide along the width of the shutter-conversion sill bracket 110 with the head of the bolt 116 disposed in the bolt groove 114 and the stem of the bolt 117 extending outward therefrom, allowing the attachment of the hurricane storm shutter 18. The lip recess 118 overlaps existing rubber window glazing to assure a water resistant seal.

Figure 7:
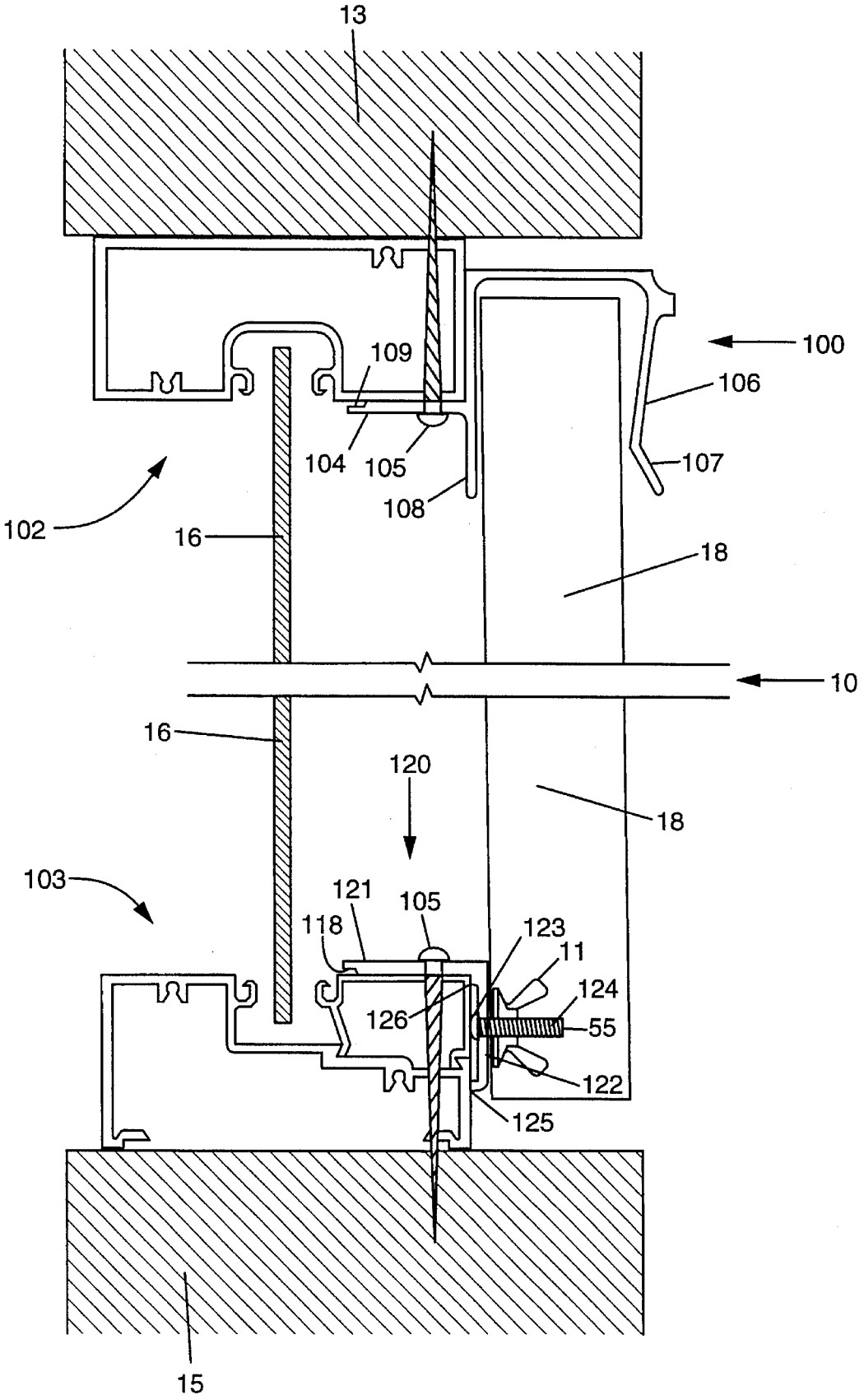
FIG. 7 is a cross-sectional view of an alternate embodiment of a retro-fitted window construction system showing a shutter mounted with studs to a store front sheet glass window unit according to the invention.

FIG. 7 is a cross sectional view of an alternate embodiment of the storm shutter system 10 which enables a shutter-conversion header bracket 100 and a shutter-conversion stud sill bracket 120 to be retro-fitted to an existing or new store front window installation. The shutter-conversion stud sill bracket 120 attaches to the top and outer surface of the lower typical store front window sill bracket 103. The horizontal placement of the studs 55 is pre-determined according to the spacing required by the hurricane storm shutters 18 to fill the horizontal dimension required. Once the shutter-conversion stud sill bracket 120 is in place, the store front window sills outer surface will prevent the studs 55 from being dislodged. A wing nut 11 secures the hurricane storm shutter to the shutter-conversion stud sill bracket 120.

Once in place, this embodiment works to convert a window only header into a combination window/shutter bracket, similar to the header bracket shown in FIG. 5. Generally, the bracket is used on store front sheet glass window systems 16. This U-shaped shutter-conversion header bracket 100 is positioned as in FIG. 6.

The shutter-conversion stud sill bracket 120 includes a horizontal arm 121 attached to a right angle to a vertical arm 122. The inner side of the vertical arm 122 has an upper space 126 and a lower return space 125. These spacers allow room for the head of the stud 123. The head of the stud 123 is held against the existing store front window sill once the sill is in place. The stem of the stud 124 protrudes through and extends outward from the vertical surface enabling the attachment of the hurricane storm shutter 18. Two drill points are scored along the horizontal surfaces of the sill, one on the upper surface and the other on the vertical surface for studs 55 and fasteners 105. The lip recess 118 overlaps existing rubber window glazing to assure a water resistent seal.

Figure 8:
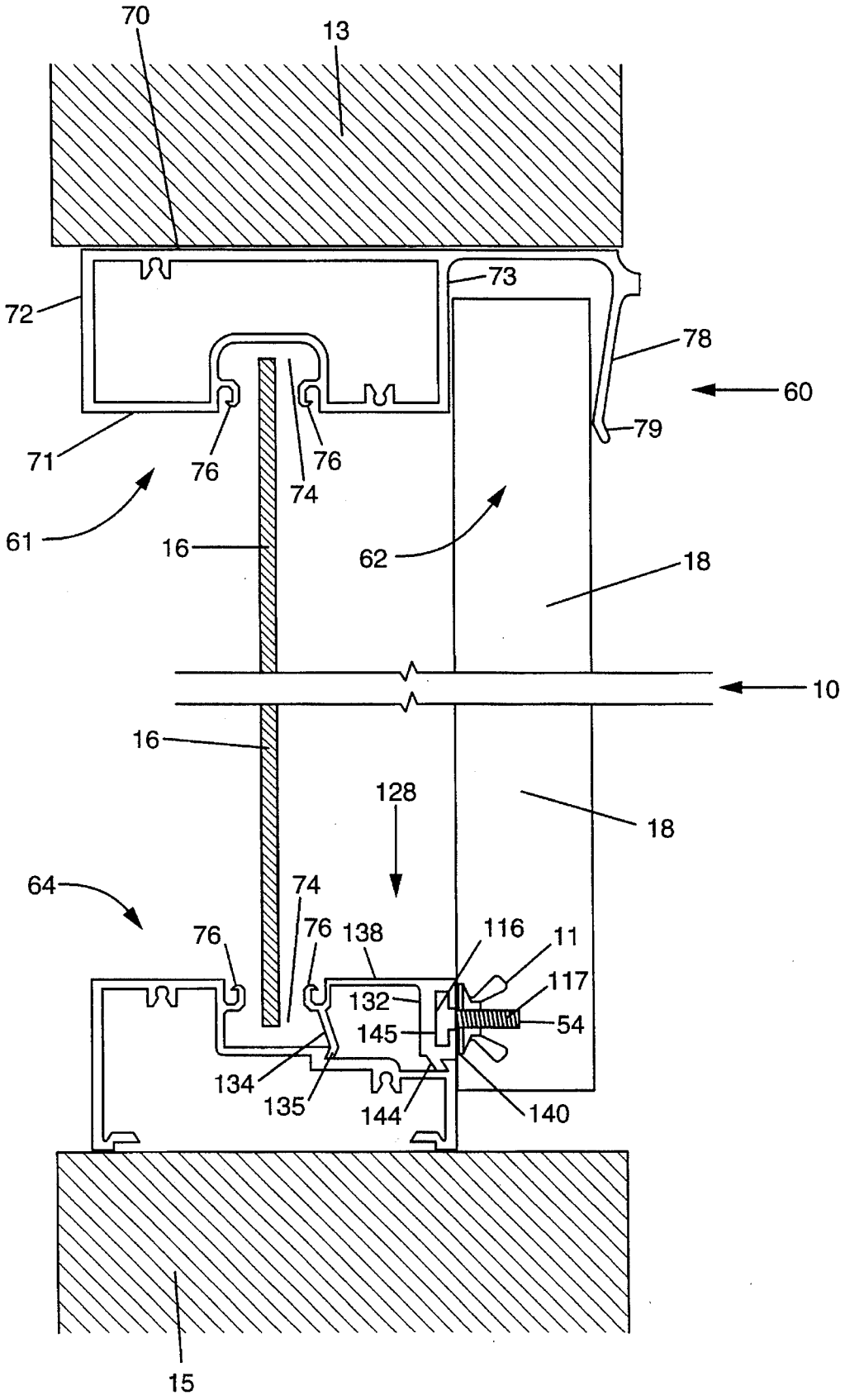
FIG. 8 is a cross-sectional view of an alternate embodiment of a window construction system showing a shutter mounted with sliding bolts to a store front sheet glass window unit according to the invention.

FIG. 8 is a cross sectional view of an alternate embodiment of the window construction system 10 for store front windows with a snap-in bolt grove sill adapter 128. The upper header bracket 60 will accept the upper end of the hurricane storm shutter and inner portion of the upper header bracket 60 is of typical design used in existing or new store front window installations. The snap-in bolt groove sill adapter 128 fits into the lower store front window sill.

The bolt groove 145 allows the horizontal adjustment of a bolt 54 with wing nut 11, which secures the hurricane storm shutter 18 of different spacing widths to the lower snap-in bolt groove sill adapter 128. The adjustment of the bolt 54 will allow a variety of storm shutters 18 produced by trade to fit the window construction system 10. The width and depth of different hurricane storm shutters manufactured may require the width of the upper hurricane storm shutter bracket 62 to vary. As for the lower snap-in bolt groove sill adapter 128, the varying width of hurricane storm shutters 18 produced by trade would only require the horizontal re-alignment of the bolt 54 in the bolt groove 145. The bolt 54 has a square head 116 so it will not rotate as the wing nut 11 is tightened or loosened. A notch is cut into the upper lip of the bolt groove 154 so the bolt 54 can be inserted into the bolt groove 154. As in most installations, the bolt groove 154 is blocked at each end by obstructions, such as jams or adjacent walls 17, 19.

The header bracket 60 includes a window bracket portion 61 with a shutter bracket portion 62 extending outward therefrom. The window bracket portion 61 is substantially rectangular in shape, having a top 70, bottom 71, and interior side 72, and an exterior side 73. The top side 70 is positioned adjacent to the window header 13 for mounting the header. A notch 74 in the bottom 71 of the window bracket portion 61 extends along the length of the header bracket 60 between the interior side 72 and exterior side 73 for insertion of the top edge of a sheet of glass 16. A pair of grip arms 76 within the notch 74 and rubber glazing secure the sheet of glass 16 in place. The notch 74 is positioned such that a space is left between the sheet of glass 16 and the shutter 18.

The shutter bracket portion 62 of the header bracket 60, which extends out from the exterior side 73 of the window bracket portion 61, includes an outer grip 78 extending vertically downward including a flared lower portion 79 to ease insertion of the shutter 18 between the exterior side 73 of the window bracket portion 61 and the outer grip 78.

The snap-in bolt groove sill adapter 128 fits into most existing store front window sills. Once in place, the bolt groove sill adapter 128 converts a window only bracket system into a combination window/shutter bracket system, similar to the systems shown in FIG. 6. The bolt groove 145 runs horizontally the length of the sill. On the low end of vertical arm 132 is an exterior snap 144 which hooks into a mated lock on existing sills. The sill adapters 128, vertical arm 132 and vertical grip arm 134 are spacedly connected by a horizontal spacing member 138. The vertical grip arm 134 includes a flared inner grip flange 135 and a rubber glazing grip arm 76. The face of the sill 140 aligns with the lower sill and provides the surface to mount hurricane storm shutter 18. The bolt 54 may slide along the width of the lower bolt groove 145 with the head 116 of the bolt disposed in the bolt groove 145 and stem 117 of the bolt extending outward therefrom. Sliding the bolts 54 allow for positioning the bolts in line with holes in the storm shutters 18.

To install the hurricane storm shutters, the upper end of the shutter 18 is inserted into the shutter bracket portion of 62 between an exterior 73 and an outer grip 78. The lower edge of the shutter 18 is pressed against the outer face 140 of the snap-in bolt groove sill adapter 128 the stems 117 of the bolts 54 penetrate the holes in the storm shutter 18. The bolts 54 can be removed during storage and installed during the installation of the storm shutters 18.

Figure 9:
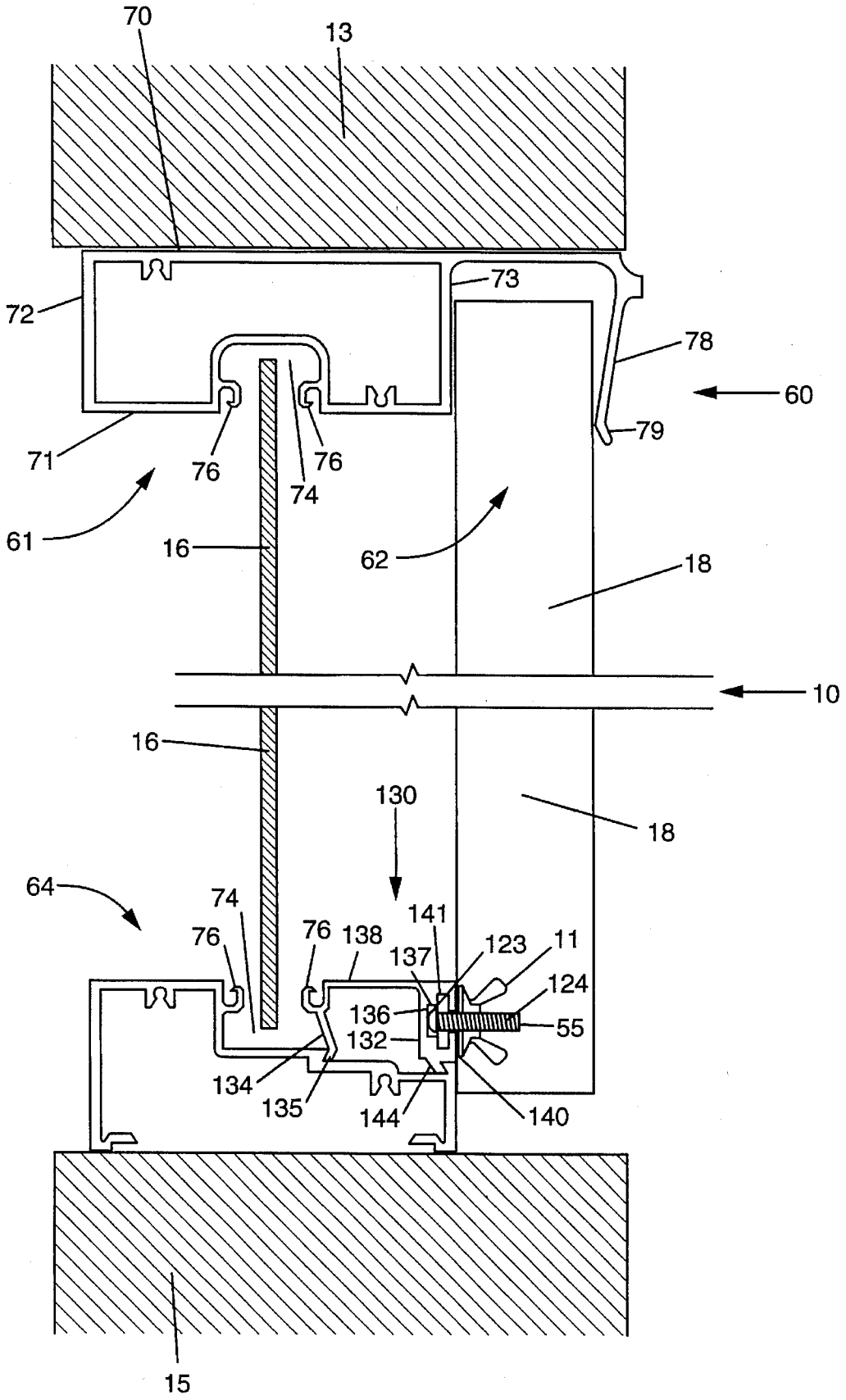
FIG. 9 is a cross-sectional view of an alternate embodiment of a window construction system showing a shutter mounted with studs to a store front sheet glass window unit according to the invention.

FIG. 9 is a cross-sectional view of an alternate embodiment of the window construction system with a snap-in internal stud mount sill adapter 130 in lieu of the snap-in bolt groove sill adapter 128 in FIG. 8. The upper header bracket is as described with reference to FIG. 8. Once in place, the snap-in internal stud mount sill adapter works to convert a window only system into a window/shutter construction system as shown in FIG. 7.

The snap-in internal stud mount sill adapter 130 fits into the lower typical store front window sill. The studs 55 are placed in the internal stud mount 141 of the snap-in internal stud mount sill adapter 130. The horizontal placement of the stud 55 is pre-determined allowing the spacing required by the hurricane storm shutters 18 to fill the horizontal dimension required. The studs 55 and internal stud mount 141 are then slid into the snap-in internal stud mount sill adapter 130. Once the studs 55 and internal stud mount 141 are in place, the back wall of the stud mount groove 136 will secure the studs 55 from being dislodged. A wing nut 11 secures the hurricane storm shutter 18 to the snap-in internal stud mount sill adapter 130. As in most installations, the bolt groove 136 is blocked at each end by obstructions, such as jams or adjacent walls 17, 19.

The snap-in internal stud mount sill adapter 130 includes a vertical arm 132 with an internal stud mount sill adapter groove 136 running horizontally the length of the sill. On the low end of vertical arm 132 is a exterior snap 144 which hooks into a mated lock on existing sills. The snap-in stud sill 130 vertical arm 132 and vertical grip arm 134 are spacedly connected by a horizontal spacing member 138. The vertical grip arm 134 includes a flared inner grip flange 135 and a rubber glazing grip arm 76. The face of the sill 140 aligns with the lower sill and provides the surface to mount hurricane storm shutters 18. The horizontal placement of the studs 55 is pre-determined allowing proper spacing for the width of hurricane storm shutters 18 being used.

The internal stud mount 141 can be installed or removed from the internal stud mount sill adapter groove 136. A center line runs the width of the internal stud mount 141. The studs 54 are pressed into the internal stud mount 141 and in turn, the internal stud mount 141 is slid into the internal stud sill mount sill adapter groove 136. A space 137 provides a clearing for the stud head 123 and also provides a lock so the stud 55 can not be dislodged.

The shutters 18 are then installed in the following manner. The upper edge of shutter 18 is inserted into the shutter bracket portion of 62 between an exterior 73 and outer grip 78. The lower edge of the shutter 18 is pressed against the outer face 140 of the snap-in internal stud mount sill 130. The stem of the stud 124 penetrates holes in the shutter 18. The number of studs 55 will vary depending on the width of the opening to be covered, the number of storm shutters 18 and the spacing between the holes on each shutter. The studs 55 can not be removed during storage and are installed during the manufacturing process. Prior to tightening the wing nuts, the storm shutters 18 can be slid along the header and sill brackets 62, 130 to the desired positions.

Figure 10:
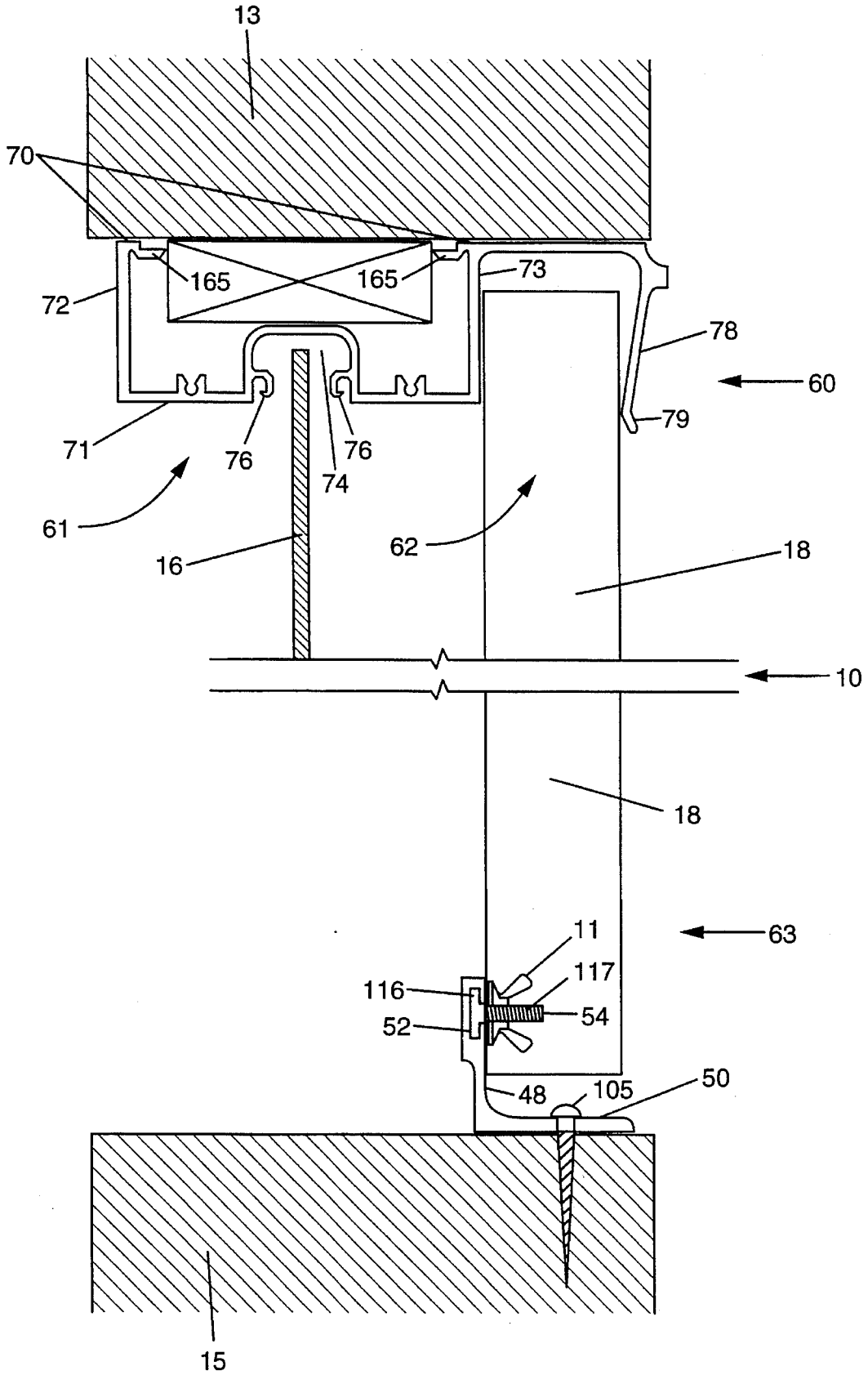
FIG. 10 is a cross-sectional view of an alternate embodiment of a window construction system showing a shutter mounted with sliding bolts to a store front sheet glass window unit according to the invention.

FIG. 10 is a cross-sectional view of an alternate embodiment of the window construction system with a bolt groove angle mount 63. The upper header bracket 60 is similar to that depicted in FIG. 9 except for the open top which will allow a strengthening component to be placed inside the header bracket or allow an opened bottom internal bolt groove sill to be mounted to its top. The stacking of headers and sills allows horizontal brakes in the window construction system to comply with local wind load codes for hurricane shutter spans. In this alternate embodiment, the top side 70 of the upper header bracket 60 is split, allowing multiple story window mounting. The right and left sides of the split have grips 165 for mounting of various adapters typical in the store front glazing industry. To mount multiple story windows, the header bracket 60 of a lower window supports the sill bracket of the above window.

The bolt groove angle mount 63 is secured to the window sill or floor. The bolt groove 52 allows the horizontal adjustment of a bolt 54 with wing nut 11 which secures the hurricane storm shutters 18 of different spacing widths to the lower bolt groove angle mount 63. The adjustment of the bolt 54 will allow a variety of storm shutters produced by trade to fit the window construction system. The varying width of hurricane storm shutters produced by trade would only require the horizontal re-alignment of the bolt 54 in the bolt groove 52. The bolt 54 has a square head 116 so it will not rotate as the wing nut 11 is tightened or loosened. A notch is cut into the upper lip of the bolt groove 52 so the bolt 54 can be inserted into the bolt groove 52. As in most cases, the bolt groove 52 is blocked at each end by obstructions, such as by jams or adjacent walls 17, 19. The lower bolt groove angle mount outer face 48 includes a bolt groove 52 along the width of the angle mount whereby a bolt 54 may slide along the width of the bolt groove angle mount 63 with the stem 117 of the bolt 54 extending outward therefrom. The exterior lip 50 is preferably constructed with a 5° slope with a radius ascending to the bolt groove to allow water to flow off the lip 50. A drill point score line runs the entire length of the lip for the installation of fasteners 105 according to municipal code.

To install the hurricane storm shutter the upper edge of the shutter 18 is inserted into the shutter bracket portion of 62 between an exterior 73 and an outer grip 78. The lower edge of the shutter 18 is pressed against the outer flare 48 of the bolt groove angle mount 63. The stem 117 of the bolt penetrates the holes in the shutter 18. The bolts 54 can be removed during storage and installed during the installation of the shutters 18.

Figure 11:
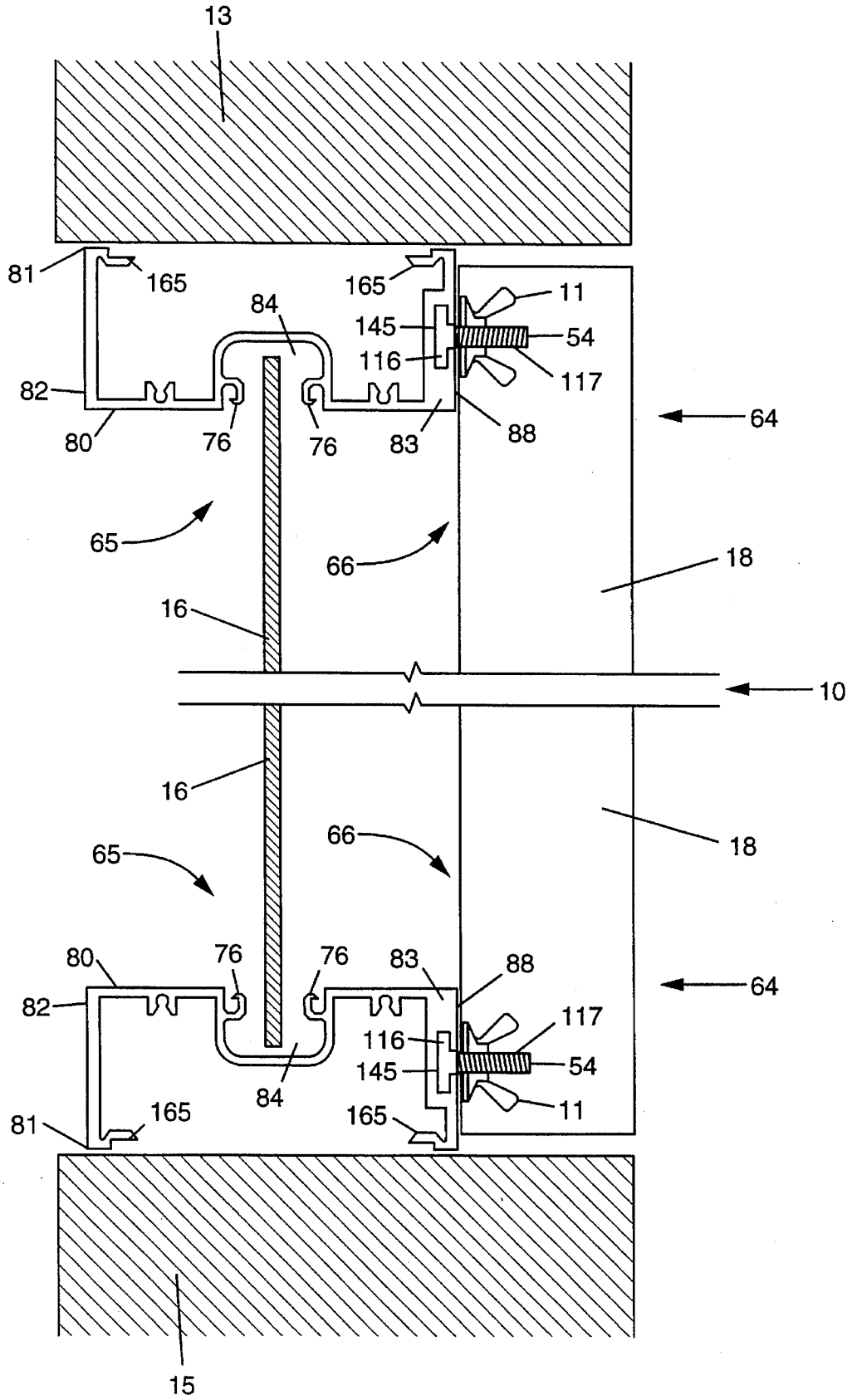
FIG. 11 is a cross-sectional view of an alternate embodiment of a window construction system showing a shutter mounted with sliding bolts on both the upper and lower brackets to a store front sheet glass window unit according to the invention.

FIG. 11 is a cross sectional view of an alternate embodiment of the window construction system with an internal bolt groove bracket 64, which is similar to the snap-in bolt groove sill adapter 128 fitted into a lower store front window sill of FIG. 8. The internal bolt groove bracket 64 may be used as a header and/or sill bracket and may also be mounted horizontally or vertically. To use this type of system, both ends of the hurricane storm shutters are punched with one round hole 8 and one elongated hole 9.

The bolt groove 145 allows the horizontal adjustment of a bolt 54 with wing nut 11 as described with reference to FIG. 8, securing the hurricane storm shutters 18 of different spacing widths to both the lower and upper mounts. The internal bolt groove bracket 64 is substantially rectangular in shape, having a top 80, bottom 81 an interior side 82, and exterior side 83. The bottom is positioned adjacent to the window sill 15 for mounting the sill. The internal bolt groove bracket 64 when inverted becomes a header the bottom side 81 mounting to the store front header 13. The bottom 81 is split, allowing multiple story window mounting. The right and left sides of the split 81 have grips for the mounting of various adapters typical in the store front glazing industry.

The window bracket portion 65 of the internal bolt groove bracket 64 is described with reference to FIG. 8.

The shutter bracket portion 66 of the sill bracket 64, includes an outer face 88 which extends vertically upward from the window sill 15 along the exterior side 83 of the window bracket portion 65. The outer face 88 includes a bolt groove 145 along the width of the sill bracket 64 whereby a bolt 54 may slide along the width of the sill bracket 64 with the head of the bolt 116 disposed in the bolt groove 145 and the stem of the bolt 117 extending outward therefrom.

To install the hurricane storm shutter 18 one round hole 8 and one elongated hole 9 will be in each end of hurricane shutter 18. The upper and lower edge of the shutter 18 will rest against the face 88 of the bolt groove 145. The stem 117 of the bolt penetrates the holes of the shutter 18 and a wing nut 11 is tightened securing shutters 18 in place. The bolts 54 can be removed during storage and installed during the installation of the shutters 18.

FIG. 12*a* is a front elevated view and FIG. 12*b* is a top view of folding storm shutters 220 as used with this invention. Folding storm shutters 220 may be used in conjunction with window, sheet glass store front, sliding glass door construction systems or the like. The folding storm shutters 220 include an upper header guide assembly 212 and lower sill guide assembly 214. The track guide 222 allows the folding storm shutter 220 to operate. The folding storm shutters 220 are usually recessed into a confined space when not in use, obstructed by either jams or adjacent walls 17, 19.

FIG. 13 is a cross-sectional view of an alternate embodiment of a window construction system which holds a window 16 and folding storm shutters 220. The system comprises a header guide assembly 212 and a sill guide assembly 214. FIG. 14 shows this window construction system with the header track 218 and the sill retainer lock 219 removed from the header guide assembly 212 and the sill guide assembly 214. When assembled, the header track 218 and the sill retainer lock 219 are snapped into place. The removable header track 218 allows the folding storm shutter 220 to be removed or installed. The removable sill retainer lock 219 allows the lower rollers 253 of the folding storm shutter 220 to be swung into place. The folding storm shutter 220 opens and closes along the upper and lower guide assembly tracks. Both the header guide assembly 212 and a sill guide assembly 214 are confined in width and height, by jams or adjacent walls 17, 19.

The header guide assembly 212 comprises a header track 218 which will accept the wheels 254 and guide rollers 252 of most typical folding storm shutters 220 manufactured. The inner portion 242 of the header guide assembly 212 will accept the upper portion of most standard window units, as described with reference to the window bracket portion 22 of the header bracket 12 of FIG. 4.

The upper shutter portion 250 of the header guide assembly 212, which extends toward the exterior of the building, spaced apart from the window bracket portion 22 by the extension arm 24, includes a vertical retainer arm 255 and a horizontal header mount 256. The vertical retainer arm 255 comprises a beveled corner seat 227 on a bottom end thereof and the horizontal header mount 256 comprises an upper male snap lock 230 on an exterior end thereof to secure the header track 218 when snapped in place into the upper female snap lock 226 of the header track 218. Screw bosses 239 may be located in various places to attach jams or end caps. Drill point score lines 240 may be provided in various locations for guiding the mounting procedure.

The removable header track 218 is substantially rectangular in shape. It comprises an inner compartment 257 for housing the wheels 254 of folding storm shutter 220. The outer compartment 258 spacedly sets out the outer face 228 from the inner compartment 257 for providing a surface upon which the upper roller 252 of folding storm shutter 220 can rest when its in the closed position. The header track 218 is snapped into place with the inner face 259 adjacent to the vertical retainer arm 255 and the upper face 260 against the horizontal header mount 256. The beveled corner seat 227 holds the edge rest 261 and the upper male snap lock 230 contacts the upper female snap lock 226. Once in place the header track 218 is secured through the horizontal header mount 256 into the window header 13 through drill point score lines 240. The inner compartment 257 comprises multiple guide channels 233 which accept the wheels 254. The guide channels 233 include roller tracks 223 to support the lower portion of the wheels 254. Roller retainers 225 are provided to prevent the wheels 254 from coming out of their roller tracks 223. The roller guide flange 234 provides a rest for the inner upper roller 252 in the event of negative wind loads. The outer face 228 has a strengthening flange 235 projecting inwardly to support rollers 252 during positive wind loads.

The lower sill guide assembly 214 will accept the lower rollers 253 of most folding storm shutters 220 manufactured. The inner window bracket portion 244 of the sill guide assembly 214 will hold the lower portion of most standard window units 16, as described with reference to the window bracket portion 36 of the sill bracket 14 of FIG. 4. The lower shutter portion 251 is spacedly connected to the inner window bracket portion 244 by means of an extension section arm 40.

The lower shutter portion 251 comprises a vertical retainer support 262 and a horizontal sill mount 263. The horizontal sill mount 263 may be provided with screw bosses 239 for holding jams or end caps. The inner lower roller 253 of the folding storm shutter 220 will rest against the vertical retainer support 262. The removable sill retainer lock 219 is substantially U-shaped. The removable sill retainer lock 219 comprises a lower inner roller guide flange 236 for supporting the lower roller 253 during negative loads and an outer face 229 for supporting the lower roller 253 during positive wind loads. The upper face 264 of the removable sill retainer lock 219 spacedly connects the lower inner roller guide flange 236 and the outer face 229 with radius corners 224 for safety. The lower inner roller guide flange 236 includes a snap lip 237 on a bottom edge thereof for snapping into the snap catch 238 of the horizontal sill mount 263. The outer face 229 includes a lower male snap lock 232 which snaps into the lower female snap lock 231 of the horizontal sill mount 263. The removable sill retainer lock 219 may be additionally secured by fastening through the upper face 264 through the horizontal sill mount 263 into the window sill 15 by fasteners. Once in place, the removable sill retainer lock 219 provides a inner track guide 222 between the vertical retainer support 262 and the lower inner roller guide flange 236 for accepting the guide rollers 253 of the folding storm shutters 220.

The folding storm shutter 220 is installed in the following manner. The wheels 254 are placed into the multiple guide channels 233 of the removable header track 218. The header track 218 is snapped into place with the inner face 259 adjacent to the vertical retainer arm 255 and the upper face 260 against the horizontal header mount 256. The beveled corner seat 227 holds the edge rest 261 and the upper male snap lock 230 contacts the upper female snap lock 226. Next the removable sill retainer lock 219 is positioned between the two lower rollers 253 of the folding storm shutter 220. The folding storm shutter 220 is then swung into place up against the vertical retainer support 262. The snap lip 237 drops into the snap catch 238 and is moved outwardly to lock. The outer face 229 of the removable sill retainer lock 219 is then forced downward, allowing the lower male snap lock 232 to couple with the lower female snap lock 231. The horizontal sill mount 263 is preferably sloped to allow water to drain. The removable sill retainer lock 219 preferably also has multiple notches for drainage along the lower surface.

FIG. 15 is a cross-sectional view of an alternate embodiment showing typical sliding glass door tracks 241, 243 in place of the window mounting system 242, 244 of FIGS. 13–14. The sliding door header portion 241 of the window header guide assembly 212 will accept the upper portion of most sliding glass door units. The lower extension arms 265 of the sliding door header portion 241 are mounted lower to be on the same horizontal plane as the base of the vertical retainer arm 255. The extension arm 24 spacedly divides the sliding door header portion 241 and the upper shutter portion 250. Drill point score line 240 extends horizontally along the surface of extension arm 24 for guiding the mounting of fasteners into window header 13. The upper shutter portion 250 is described above with reference to FIGS. 13 and 14.

The sliding door sill portion 243 will hold the lower portion of most sliding glass doors between the lower door tracks 266. The sliding door sill portion 243 is elevated to a horizontal plane to intercept with the extension section arm 40 to aid in installing and removing the doors and to provide for drainage. The extension section arm 40 spacedly divides the sliding door sill portion 243 and the lower shutter portion 251. The lower shutter portion 251 is described with reference to FIGS. 13 and 14. The folding storm shutter 220 is installed in the same fashion as described with reference to FIGS. 13 and 14.

FIG. 16 is a cross-sectional view of an alternate embodiment showing the sliding glass door assembly of FIG. 15 in combination with the shutter bracket portions 20, 38 of the header bracket 12 and the sill bracket 14 in FIG. 4. The hurricane storm shutter 18 is installed as defined with reference to FIG. 4.

FIG. 17 is a cross-sectional view of an alternate embodiment showing a store front window system in place of the window mounting system 242, 244 of FIGS. 13–14. The store front window system comprises the window bracket portion 61 of the header bracket 60 shown in FIG. 10 and the lower store front window sill 103 shown in FIG. 6. The extension arm 24 spacedly divides the window bracket portion 61 and the upper shutter portion 250. The window bracket portion 61 is mounted to the window header 13 by fastening through notch 84. Drill point score line 240 extends horizontally along the surface of extension arm 24 for guiding the mounting of fasteners into window header 13. The top surface 80 of the window bracket portion 61 is on the same horizontal plane as the lower portion of the vertical retainer arm 255. The upper shutter portion 250 is described above with reference to FIGS. 13 and 14.

The lower store front window sill 103 is elevated on internal and external legs 267, 268 above the plane of the extension section arm 40 to aid in installing and removing a sheet of store front glass 16 and to provide for drainage. The extension section arm 40 spacedly divides the lower store front window sill 103 and the lower shutter portion 251. The lower shutter portion 251 is described with reference to FIGS. 13 and 14. The folding storm shutter 220 is installed in the same fashion as described with reference to FIGS. 13 and 14.

Accordingly, it will be understood that the preferred embodiment and alternative embodiment of the present invention have been disclosed by way of example and that other modifications and alterations may occur to those skilled in the art without departing from the scope and spirit of the appended claims.

What is claimed is:

1. An integrated window construction system wherein both window units and hurricane shutters are mounted between a window header and a window sill, comprising:

a header bracket integrally fastened to said window header, comprising:

a window header bracket portion; and an upper shutter bracket portion spacedly connected to said window header bracket portion by an extended member, said extended member defining a space between said window units and said hurricane shutters; and a sill bracket integrally fastened to said window sill, comprising:

a window sill bracket portion; and a lower shutter bracket portion spacedly connected by an extended section, said extended section defining a space between said window units and said hurricane shutters.

2. The window construction system of claim 1 wherein said upper shutter bracket portion of said header bracket comprises an inner grip and an outer grip extending vertically downward, wherein each of said grips comprises a flared lower portion to ease insertion of said hurricane shutters between said grips.

3. The window construction system of claim 1 wherein said window header bracket portion of said header bracket comprises a front grip and a rear grip in which a window unit is retained and a horizontal bracing cap between said front and rear grips, said bracing cap slidably adjustable to accept windows of various depths.

4. The window construction system of claim 3 wherein said window bracket portion of said sill bracket comprises a front edge and a raised rear lip in which said window unit is retained and a horizontal bracing cap between said front edge and said raised rear lip, said bracing cap slidably adjustable to accept windows of various depths.

5. The window construction system of claim 1 wherein said window header bracket portion of said header bracket retains a sliding glass door.

6. The window construction system of claim 5 wherein said window sill bracket portion of said sill bracket retains a sliding glass door.

7. The window construction system of claim 1 wherein said lower shutter bracket portion of said sill bracket comprises an outer face which extends vertically upward from said window sill and a lower exterior horizontal lip which rests on said window sill.

8. The window construction system of claim 7 wherein said outer face comprises a bolt groove along the width of said sill bracket within which a head of a bolt may be disposed, with a stem of said bolt extending outward therefrom, allowing said bolt to slide along said bolt groove, and wherein for each of said hurricane shutters said bolt extends through said hurricane shutter to secure said hurricane shutter.

9. The window construction system of claim 8 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolt slides along said bolt groove for horizontal width adjustment of said hurricane shutter.

10. The window construction system of claim 7 wherein said outer face comprises a plurality of studs, spacedly secured, wherein a stem of each of said studs extends outward therefrom, and wherein for each of said hurricane shutters said stem extends through said hurricane shutter to secure said hurricane shutter and wherein a lock bar prevents said studs from becoming dislodged.

11. The window construction system of claim 10 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said stud penetrating said elongated hole.

12. An integrated window construction system wherein both window units and hurricane shutters are mounted between a window header and a window sill, comprising:

a header bracket integrally fastened to said window header, comprising:

a window header bracket portion; and an upper shutter bracket portion spacedly connected to said window header bracket portion by an extended member, said extended member defining a space between said window units and said hurricane shutters, said upper shutter bracket portion of said header bracket comprising an inner grip and an outer grip extending vertically downward, wherein each of said grips comprises a flared lower portion to ease insertion of said hurricane shutters between said grips; and a sill bracket integrally fastened to said window sill comprising:

a window sill bracket portion; and a lower shutter bracket portion spacedly connected by an extended section, said extended section defining a space between said window units and said hurricane shutters, said lower shutter bracket portion of said sill bracket comprising:

an outer face which extends vertically upward from said window sill, said outer face comprising for each of said hurricane shutters a bolt groove along the width of said sill bracket within which a head of a bolt may be disposed, with a stem of said bolt extending outward therefrom, allowing said bolt to slide along said bolt groove, and wherein said bolt extends through said hurricane shutter to secure said hurricane shutter; and a lower exterior horizontal lip which rests on said window sill;

each of said hurricane shutters comprising a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolt slides along said bolt groove for horizontal width adjustment of said hurricane shutter.

13. An integrated window construction system wherein both sheet glass windows and hurricane shutters are mounted between a window header and a window sill, comprising:

a header bracket integrally fastened to said window header comprising an upper shutter bracket portion attached to a window header bracket portion; and a sill bracket integrally fastened to said window sill comprising a lower shutter bracket portion attached to a window sill bracket portion, said lower shutter bracket portion comprising an outer face, wherein said outer face comprises a bolt groove along the width of said sill bracket within which a head of a bolt may be disposed, with a stem of said bolt extending outward therefrom, allowing said bolt to slide along said bolt groove, and wherein said bolt extends through said hurricane shutter to secure said hurricane shutter.

14. The window construction system of claim 13 wherein said window header bracket portion is substantially rectangular in shape, having a top side, a bottom side, an interior side and an exterior side, said top side positioned adjacent to said window header for mounting to said window header, said window header bracket portion comprising a notch in said bottom side of said window header bracket portion extending along the length of said header bracket between said interior side and said exterior side for insertion of a top edge of a sheet of glass, wherein a pair of grip arms within said notch secure said sheet of glass in place, said notch positioned such that a space is left between said sheet of glass and said hurricane shutters.

15. The window construction system of claim 13 wherein said upper shutter bracket portion of said header bracket comprises an inner arm and an outer grip extending vertically downward with a flared lower portion to ease insertion of said hurricane shutters between said exterior side of said window header bracket portion and said outer grip, said upper shutter bracket portion attaching to said bottom side against said exterior side of said window header bracket portion through a horizontal mounting means extending inward from said inner arm.

16. The window construction system of claim 13 wherein said window sill bracket portion of said sill bracket is substantially rectangular in shape, having a top side, a bottom side, an interior side and an exterior side, said bottom side positioned adjacent to said window sill for mounting, said window sill bracket portion comprising a notch in said top side of said window sill bracket portion of said sill bracket extending along the length of said sill bracket between said interior side and said exterior side of said sill bracket for insertion of a bottom edge of a sheet of glass, wherein a pair of grip arms within said notch secure said sheet of glass in place, said notch positioned such that a space is left between said sheet of glass and said hurricane shutters.

17. The window construction system of claim 13 wherein said lower shutter bracket portion of said sill bracket comprises a horizontal mounting arm and said outer face extends vertically downward, said lower shutter bracket portion attaching to a top side against an exterior side of said window sill bracket portion through said horizontal mounting arm.

18. The window construction system of claim 13 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolt slides along said bolt groove for horizontal width adjustment of said hurricane shutter.

19. The window construction system of claim 13 wherein said outer face comprises a plurality of studs, spacedly secured, wherein a stem of each of said studs extends outward therefrom, and wherein for each of said hurricane shutters said stem extends through said hurricane shutter to secure said hurricane shutter, and wherein mounting of said hurricane shutters prevents said studs from becoming dislodged.

20. The window construction system of claim 19 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said stud penetrating said elongated hole.

21. An integrated window construction system wherein both sheet glass windows and hurricane shutters are mounted between a window header and a window sill, comprising:

a header bracket integrally fastened to said window header comprising an upper shutter bracket portion attached to a window header bracket portion, said upper shutter bracket portion of said header bracket comprising an inner arm and an outer grip extending vertically downward with a flared lower portion to ease insertion of said hurricane shutters between an exterior side of said window bracket portion and said outer grip, said shutter bracket portion attaching to a bottom side of said window bracket portion against said exterior side of said window bracket portion through a horizontal mounting means extending inward from said inner arm; and a sill bracket integrally fastened to said window sill comprising a lower shutter bracket portion attached to a window sill bracket portion, said lower shutter bracket portion of said sill bracket comprising:

a horizontal mounting arm, said lower shutter bracket portion attached to a top side of said window sill bracket portion against an exterior side of said window sill bracket portion through said horizontal mounting arm; and an outer face extending vertically downward, said outer face comprising a bolt groove along the width of said sill bracket within which a head of a bolt may be disposed, with a stem of said bolt extending outward therefrom, allowing said bolt to slide along said bolt groove, and wherein for each of said hurricane shutters said bolt extends through said hurricane shutter to secure said hurricane shutter;

each of said hurricane shutters comprising a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with a stem of said bolt penetrating said elongated hole, and wherein said bolt slides along said bolt groove for horizontal width adjustment of said hurricane shutter.

22. An integrated window construction system wherein both sheet glass windows and hurricane shutters are mounted between a window header and a window sill, comprising:

a header bracket integrally fastened to said window header, comprising:

a window header bracket portion; and an upper shutter bracket portion spacedly connected to said window header bracket portion by an extended member, said extended member defining a space between said sheet glass windows and said hurricane shutters; and a sill bracket integrally fastened to said window sill comprising a lower shutter bracket portion attached to a window sill bracket portion.

23. The window construction system of claim 22 wherein said window header bracket portion is substantially rectangular in shape, having a top side, a bottom side, an interior side and an exterior side, said top side positioned adjacent to said window header for mounting to said window header, said window header bracket portion comprising a notch in said bottom side of said window header bracket portion extending along the length of said header bracket between said interior side and said exterior side of said window header bracket portion for insertion of a top edge of a sheet of glass, wherein a pair of grip arms within said notch secure said sheet of glass in place, said notch positioned such that a space is left between said sheet of glass and said hurricane shutters.

24. The window construction system of claim 23 wherein said upper shutter bracket portion of said header bracket comprises an outer grip extending vertically downward with a flared lower portion to ease insertion of said hurricane shutters between said exterior side of said window header bracket portion and said outer grip.

25. The window construction system of claim 22 wherein said window sill bracket portion of said sill bracket is substantially rectangular in shape, having a top side, a bottom side, an interior side and an exterior side, said bottom side positioned adjacent to said window sill for mounting.

26. The window construction system of claim 25 wherein said lower shutter bracket portion of said sill bracket comprises an outer face which extends vertically upward from said window sill and is snapped into said exterior side of said window sill bracket portion.

27. The window construction system of claim 26 further comprising a notch formed between said top side of said window sill bracket portion and said lower shutter bracket portion extending along the length of said sill bracket between said interior side and said exterior side of said window sill bracket portion for insertion of a bottom edge of a sheet of glass, wherein a pair of grip arms within said notch secure said sheet of glass in place, and wherein said notch is positioned such that a space is left between said sheet of glass and said hurricane shutters.

28. The window construction system of claim 26 wherein said outer face comprises a bolt groove along the width of said sill bracket whereby a bolt may slide along the width of said sill bracket with a head of said bolt disposed in said bolt groove and a stem of said bolt extending outward therefrom.

29. The window construction system of claim 28 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolts slide along said bolt groove for horizontal width adjustment of said hurricane shutter.

30. The window construction system of claim 26 wherein said outer comprises a plurality of studs along the width of said sill bracket whereby for each of said hurricane shutters a stem of each of said studs extends outward therefrom for attachment of said hurricane shutter, and wherein an internal stud mount prevents said studs from becoming dislodged.

31. The window construction system of claim 30 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said stud penetrating said elongated hole.

32. An integrated window construction system wherein both sheet glass windows and hurricane shutters are mounted between a window header and a window sill, comprising:

a header bracket integrally fastened to said window header, comprising:

a window header bracket portion; and an upper shutter bracket portion spacedly connected to said window header bracket portion by an extended member, said extended member defining a space between said sheet glass windows and said hurricane shutters, said upper shutter bracket portion of said header bracket comprising an outer grip extending vertically downward with a flared lower portion to ease insertion of said hurricane shutters between an exterior side of said window header bracket portion and said outer grip; and a sill bracket integrally fastened to said window sill comprising a lower shutter bracket portion attached to a window sill bracket portion, said lower shutter bracket portion of said sill bracket comprising an outer face which extends vertically upward from said window sill and is snapped into an exterior side of said window sill bracket portion, said outer face comprising a bolt groove along the width of said sill bracket whereby a bolt may slide along the width of the said sill bracket with a head of said bolt disposed in said bolt groove and a stem of said bolt extending outward therefrom;

each of said hurricane shutters comprising a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolt slides along said bolt groove for horizontal width adjustment of said hurricane shutter.

33. An integrated window construction system wherein both sheet glass windows and hurricane shutters are mounted between a window header and a window sill are mounted, comprising:

a header bracket integrally fastened to said window header comprising an upper shutter bracket portion attached to a window header bracket portion; and a lower shutter bracket portion integrally attached to said window sill, said lower shutter bracket portion comprising an outer face, wherein said outer face comprises a bolt groove along the width of said sill bracket within which a head of a bolt may be disposed, with a stem of said bolt extending outward therefrom, allowing said bolt to slide along said bolt groove, and wherein for each of said hurricane shutters said bolt extends through said hurricane shutter to secure said hurricane shutter.

34. The window construction system of claim 33 wherein said window header bracket portion is substantially rectangular in shape, having a top side, a bottom side, an interior side and an exterior side, said top side positioned adjacent to said window header for mounting to said window header, said window header bracket portion comprising a notch in said bottom of said window header bracket portion extending along the length of said header bracket between said interior side and said exterior side of said window header bracket portion for insertion of a top edge of a sheet of glass, wherein a pair of grip arms within said notch secure said sheet of glass in place, said notch positioned such that a space is left between said sheet of glass and said hurricane shutters.

35. The window construction system of claim 34 wherein said upper shutter bracket portion of said header bracket comprises an inner arm and an outer grip extending vertically downward with a flared lower portion to ease insertion of said hurricane shutters between said exterior side of said window header bracket portion and said outer grip, said upper shutter bracket portion attaching to said bottom side against said exterior side of said window header bracket portion through a horizontal mounting means extending inward from said inner arm.

36. The window construction system of claim 35 wherein said lower shutter bracket portion comprises an L-shaped member and a horizontal mounting arm, said outer face extending vertically downward and said lower shutter bracket portion attaching to said window sill through said horizontal mounting arm.

37. The window construction system of claim 33 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolt slides along said bolt groove for horizontal width adjustment of said hurricane shutter.

38. The window construction system of claim 33 wherein said outer face comprises a plurality of studs, spacedly secured, wherein a stem of each of said studs extends outward therefrom, and wherein for each of said hurricane shutters said stem extends through said hurricane shutter to secure said hurricane shutter, and wherein a lock bar prevents said studs from becoming dislodged.

39. The window construction system of claim 38 wherein each of said hurricane shutters comprises a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with a stem of said stud penetrating said elongated hole.

40. An integrated window construction system wherein both sheet glass windows arid hurricane shutters are mounted between a window header and a window sill, comprising:

a header bracket integrally fastened to said window header comprising an upper shutter bracket portion attached to a window header bracket portion, said upper shutter bracket portion of said header bracket comprising an inner arm and an outer grip extending vertically downward with a flared lower portion to ease insertion of said hurricane shutters between an exterior side of said window header bracket portion and said outer grip, said upper shutter bracket portion attaching to a bottom side against said exterior side of said window header bracket portion through a horizontal mounting means extending inward from said inner arm; and a sill bracket integrally fastened to said window sill comprising a lower shutter bracket portion attached to a window sill bracket portion, said lower shutter bracket portion of said sill bracket comprising an L-shaped member having an outer face extending vertically downward and a horizontal mounting arm, said lower shutter bracket portion attaching to said window sill through said horizontal mounting arm, wherein said outer face comprises a bolt groove along the width of said sill bracket within which a head of a bolt may be disposed, with a stem of said bolt extending outward therefrom, allowing said bolt to slide along said bolt groove, and wherein for each of said hurricane shutters said bolt extends through said hurricane shutter to secure said hurricane shutter;

each of said hurricane shutters comprising a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolt slides along said bolt groove for horizontal width adjustment of said hurricane shutter.

41. An integrated window construction system wherein both sheet glass windows and hurricane shutters are integrally mounted within a window frame, comprising:

two brackets each comprising a window bracket portion attached to a shutter bracket portion, the window bracket portion having an exterior side with an outer face, said outer face comprising a means for securing at least one shutter to said outer face between said brackets, said brackets fastened opposite each other within said window frame, wherein said outer face comprises a bolt groove along the width of said brackets within which a head of a bolt may be disposed, with a stem of said bolt extending outward therefrom, allowing said bolt to slide along said bolt groove, and wherein for each of said hurricane shutters said bolt extends through said hurricane shutter to secure said hurricane shutter.

42. The window construction system of claim 41 wherein said window bracket portion is substantially rectangular in shape, having a top side, a bottom side, an interior side and an exterior side, said top side positioned adjacent to said window frame for mounting, said window bracket portion comprising a notch in said bottom side of said window bracket portion extending along the length of said brackets between said interior side and said exterior side of said window bracket portion for insertion of an edge of a sheet of glass, wherein a pair of grip arms within said notch secure said sheet of glass in place, said notch positioned such that a space is left between said sheet of glass and said hurricane shutters.

43. The window construction system of claim 41 wherein each of said hurricane shutters comprises a substantially rectangular panel-like member having a narrow inwardly projecting surface and a wide inwardly projecting surface, wherein an elongated hole is positioned along a top and a bottom edge of said wide inwardly projecting surface to allow for horizontal width adjustment of said hurricane shutter when at least two of said hurricane shutters overlap, with a stem of said bolt penetrating said elongated hole, and wherein said bolt slides along said bolt groove for horizontal width adjustment of said hurricane shutter.

44. The window construction system of claim 41 wherein said outer face comprises a plurality of studs, spacedly secured, wherein a stem of each of said studs extends outward therefrom, and wherein for each of said hurricane shutters said stem extends through said hurricane shutter to secure said hurricane shutter, and wherein a lock bar prevents said studs from becoming dislodged.

45. The window construction system of claim 44 wherein each of said hurricane shutters comprises a substantially rectangular panel-like member having a narrow inwardly projecting surface and a wide inwardly projecting surface, wherein an elongated hole is positioned along a top and a bottom edge of said wide inwardly projecting surface to allow for horizontal width adjustment of said hurricane shutter when at least two of said hurricane shutters overlap, with said stem of said stud penetrating said elongated hole.

46. An integrated window construction system wherein both sheet glass windows and hurricane shutters are integrally mounted within a window frame, comprising:

two brackets comprising:

a window bracket portion; and an outer face on an exterior side of said window bracket portion, said outer face comprising:

a means for securing at least one of said hurricane shutters to said outer face between said brackets, wherein said window bracket portion is substantially rectangular in shape, having a top side, a bottom side, an interior side and an exterior side, said top side positioned adjacent to said window frame for mounting; and a bolt groove along the width of said brackets within which a head of a bolt may be disposed, with a stem of said bolt extending outward therefrom, allowing said bolt to slide along said bolt groove, and wherein for each of said hurricane shutters said bolt extends through said hurricane shutter to secure said hurricane shutter;

wherein each of said hurricane shutters comprises a substantially rectangular panel-like member having a narrow inwardly projecting surface and a wide inwardly projecting surface, wherein a hole is positioned along an end of said narrow inwardly projecting surface, and an elongated hole is positioned along a top edge and a bottom edge of said wide inwardly projecting surface to allow for horizontal width adjustment of said hurricane shutter when at least two of said hurricane shutters overlap, with said stem of said bolt penetrating said holes, and wherein said bolt slides along said bolt groove for horizontal width adjustment of said hurricane shutter.

47. A hurricane shutter used in a window construction system, the shutter comprising a plurality of substantially rectangular panel-like members each having a narrow inwardly projecting surface and a wide inwardly projecting surface, wherein a hole is positioned along an end of said narrow inwardly projecting surface, and an elongated hole is positioned along an end of said wide inwardly projecting surface to allow for width adjustment of said hurricane shutter when at least two of said panel-like members overlap, and a securing means having a stem penetrating said holes of said projecting surfaces.

48. An integrated window construction system wherein both window units and folding hurricane shutters are mounted between a window header and a window sill, comprising:

a header guide assembly integrally fastened to said window header, comprising:

a window header bracket portion; and an upper shutter bracket portion spacedly connected to said window header bracket portion by an extended member, said extended member defining a space between said window units and said folding hurricane shutters; and a sill guide assembly integrally fastened to said window sill comprising a lower shutter bracket portion spacedly connected to a window sill bracket portion by an extended section, said extended section defining a space between said window units and said folding hurricane shutters.

49. The window construction of claim 48 said upper shutter bracket portion of said header guide assembly comprises a horizontal header mount for attaching said upper shutter bracket portion to said window header and a vertical retainer arm in which a removable header track is retained.

50. The window construction system of claim 49 wherein said removable header track comprises:

an inner compartment for housing wheels of said folding hurricane shutters; and an outer compartment having an outer face, wherein said outer face provides a surface upon which upper rollers of said folding hurricane shutters can rest when in a closed position.

51. The window construction of claim 50 wherein said lower shutter bracket portion comprises a vertical retainer support attached to a horizontal sill mount, said horizontal sill mount comprising a means for attaching a removable sill retainer lock, whereby once said removable sill retainer lock is in place, said removable sill retainer lock provides an inner track guide space between said vertical retainer support and said removable sill retainer lock for accepting guide rollers of said folding hurricane shutters.

52. The window construction of claim 48 wherein said window header bracket portion comprises an upper window bracket and said window sill bracket portion comprises a lower window bracket in which a window unit is retained.

53. The window construction of claim 48 wherein said window header bracket portion and said window sill bracket portion retain a sliding glass door unit.

54. The window construction of claim 48 wherein said window header bracket portion and said window sill bracket portion retain a sheet of glass.

55. An integrated window construction system wherein both window units and folding hurricane shutters are mounted between a window header and a window sill, comprising:

a header guide assembly integrally fastened to said window header comprising:

a window header bracket portion; and an upper shutter bracket portion spacedly connected to said window header bracket portion by an extended member, said extended member defining a space between said window units and said folding hurricane shutters, said upper shutter bracket portion of said header guide assembly comprising:

a horizontal header mount for attaching said upper shutter bracket portion to said window header; and a vertical retainer arm in which a removable header track is retained, said removable header track comprising:

an inner compartment for housing wheels of said folding hurricane shutters; and an outer compartment having an outer face, wherein said outer face provides a surface upon which upper rollers of said folding hurricane shutters can rest when in a closed position; and a sill guide assembly integrally fastened to said window sill comprising a lower shutter bracket portion spacedly connected to a window sill bracket portion by an extended section, said extended section defining a space between said window units and said folding hurricane shutters, said lower shutter bracket portion comprising a vertical retainer support attached to a horizontal sill mount, said horizontal sill mount comprising a means for attaching a removable sill retainer lock, whereby once said removable sill retainer lock is in place, said removable sill retainer lock provides an inner track guide space between said vertical retainer support and said removable sill retainer lock for accepting guide rollers of said folding hurricane shutters.

56. An integrated window construction system wherein both a sliding glass door and hurricane shutters are mounted between a window header and a window sill, comprising:

a header bracket integrally fastened to said window header comprising:

a sliding glass door bracket portion in which a sliding glass door portion is retained; and an upper shutter bracket portion spacedly connected to said window header bracket portion by an extended member, said extended member defining a space between said sliding glass door and said hurricane shutters, said upper shutter bracket portion of said header bracket comprising an inner grip and an outer grip extending vertically downward, wherein each of said grips comprises a flared lower portion to ease insertion of said hurricane shutters between said grips; and a sill bracket integrally fastened to said window sill comprising:

a sliding glass door bracket in which is retained a sliding glass door portion is retained; and a lower shutter bracket portion spacedly connected by an extended section, said extended section defining a space between said sliding glass door bracket and said hurricane shutters, wherein said lower shutter bracket portion of said sill bracket comprises:

an outer face which extends vertically upward from said window sill; and a lower exterior horizontal lip which rests on said window sill;

wherein said outer face comprises a bolt groove along the width of said sill bracket within which a head of a bolt may be disposed, with a stem of said bolt extending outward therefrom, allowing said bolt to slide along said bolt groove, and wherein for each of said hurricane shutters said bolt extends through said hurricane shutter to secure said hurricane shutter;

each of said hurricane shutters comprising a substantially rectangular panel-like member having a narrow inwardly projecting surface and a wide inwardly projecting surface, wherein an elongated hole is positioned along a bottom edge of said wide inwardly projecting surface to allow for horizontal width adjustment of said hurricane shutter when at least two of said hurricane shutters overlap, with said stem of said bolt penetrating said elongated hole, and wherein said bolt slides along said bolt groove for horizontal width adjustment of said hurricane shutter.

* * * * *